US008866685B2

(12) United States Patent
Lee et al.

(10) Patent No.: US 8,866,685 B2
(45) Date of Patent: Oct. 21, 2014

(54) OMNIDIRECTIONAL MULTI-BAND ANTENNAS

(75) Inventors: Ting Hee Lee, Penang (MY); Ng Kok Jiunn, Penan (MY); Ooi Tze Meng, Selangor Darul Ehsan (MY)

(73) Assignee: Laird Technologies, Inc., Earth City, MO (US)

( * ) Notice: Subject to any disclaimer, the term of this patent is extended or adjusted under 35 U.S.C. 154(b) by 460 days.

(21) Appl. No.: 13/419,662

(22) Filed: Mar. 14, 2012

(65) Prior Publication Data

US 2012/0169560 A1 Jul. 5, 2012

Related U.S. Application Data

(63) Continuation of application No. PCT/MY2009/000181, filed on Oct. 30, 2009.

(51) Int. Cl.

| | |
|---|---|
| ***H01Q 13/10*** | (2006.01) |
| ***H01Q 5/00*** | (2006.01) |
| ***H01Q 9/28*** | (2006.01) |
| ***H01Q 9/30*** | (2006.01) |
| ***H01Q 21/10*** | (2006.01) |

(52) U.S. Cl.

CPC ..... *H01Q 5/00* (2013.01); *H01Q 5/0058* (2013.01); *H01Q 9/28* (2013.01); *H01Q 9/30* (2013.01); *H01Q 21/10* (2013.01)

USPC ..... 343/770

(58) Field of Classification Search

CPC ..... H01Q 13/10; H01Q 13/085; H01Q 1/38; H01Q 13/18; H01Q 13/106

USPC ..... 343/767, 700, 702, 729, 783, 770

See application file for complete search history.

(56) References Cited

U.S. PATENT DOCUMENTS

| | | | | |
|---|---|---|---|---|
| 5,990,838 | A * | 11/1999 | Burns et al. | 343/702 |
| 6,337,666 | B1 | 1/2002 | Bishop | |
| 6,859,176 | B2 * | 2/2005 | Choi | 343/700 MS |
| 7,321,333 | B2 * | 1/2008 | Tsai et al. | 343/700 MS |

(Continued)

FOREIGN PATENT DOCUMENTS

| | | |
|---|---|---|
| CN | 1521887 | 8/2004 |
| CN | 101222087 | 7/2008 |

(Continued)

OTHER PUBLICATIONS

Chinese Office action dated Jan. 20, 2014 from co-pending Chinese patent application No. 200980162142.5 (published as CN102598410) which claims priority to the same parent application No. PCT/MY2009/000181 (published as WO 2011/0563107) as the instant application; 10 pages.

(Continued)

*Primary Examiner* — Huedung Mancuso

(74) *Attorney, Agent, or Firm* — Harness, Dickey & Pierce, P.L.C.

(57) ABSTRACT

Disclosed herein are various exemplary embodiments of omnidirectional multi-band antennas. In an exemplary embodiment, an antenna includes upper and lower portions. The upper portion includes one or more radiating elements, one or more tapering features for impedance matching, and one or more slots configured to enable multi-band operation of the antenna. The lower portion includes one or more radiating elements and one or more slots.

27 Claims, 32 Drawing Sheets

(56) References Cited

U.S. PATENT DOCUMENTS

| | | | | |
|---|---|---|---|---|
| 7,417,588 | B2 * | 8/2008 | Castany et al. | 343/700 MS |
| 7,443,350 | B2 * | 10/2008 | Gaucher et al. | 343/702 |
| 8,531,344 | B2 * | 9/2013 | Ayatollahi et al. | 343/793 |
| 2004/0075609 | A1 | 4/2004 | Li | |
| 2004/0222936 | A1 | 11/2004 | Hung et al. | |
| 2005/0073465 | A1 | 4/2005 | Olson | |
| 2006/0158383 | A1 | 7/2006 | Kwon et al. | |
| 2006/0170604 | A1 | 8/2006 | Almog et al. | |

FOREIGN PATENT DOCUMENTS

| | | |
|---|---|---|
| CN | 201138684 | 10/2008 |
| JP | 2008079246 | 4/2008 |
| JP | 2008-306436 | 12/2008 |
| TW | 201140940 | 11/2011 |
| WO | WO 2011/053107 | 5/2011 |

OTHER PUBLICATIONS

International Search Report and Written Opinion dated Jun. 24, 2010 for PCT/MY2009/000181 (published as WO 2011/053107 on May 5, 2011). The instant application is a continuation of PCT/MY2009/000181; 13 pages.

Second Chinese Office Action from co-pending Chinese patent application No. 200980162142.5 (published as CN102598410) which claims priority to the same parent application No. PCT/MY2009/000181 (published as WO 2011/0563107) as the instant application; 22 pages.

Taiwan Office Action dated May 19, 2014 for Taiwan patent application No. 099137143 which claims priority to the same parent application as the instant application; 10 pages.

* cited by examiner 2400.00(MHz) 2450.00(MHz) 2500.00(MHz)

4900.00(MHz) 5150.00(MHz) 5350.00(MHz) 5850.00(MHz)

2400.00(MHz) 2450.00(MHz) 2500.00(MHz)

4900.00(MHz) 5150.00(MHz) 5350.00(MHz) 5470.00(MHz)
5710.00(MHz) 5780.00(MHz) 5850.00(MHz)

2400.00(MHz) 2450.00(MHz) 2500.00(MHz)

4900.00(MHz) 5150.00(MHz) 5350.00(MHz) 5470.00(MHz)
5710.00(MHz) 5780.00(MHz) 5850.00(MHz)

2400.00(MHz) 2450.00(MHz) 2500.00(MHz)

4900.00(MHz) 5150.00(MHz) 5350.00(MHz) 5470.00(MHz)
5710.00(MHz) 5780.00(MHz) 5850.00(MHz)

OMNIDIRECTIONAL MULTI-BAND ANTENNAS

CROSS-REFERENCE TO RELATED APPLICATION

This application is a continuation of PCT International Patent Application No. PCT/MY2009/000181 filed Oct. 30, 2009 (published as WO2011/053107 on May 5, 2011). The entire disclosure of the above application is incorporated herein by reference.

FIELD

The present disclosure relates to omnidirectional multi-band antennas.

BACKGROUND

This section provides background information related to the present disclosure which is not necessarily prior art.

Wireless application devices, such as laptop computers, cellular phones, etc. are commonly used in wireless operations. Consequently, additional frequency bands are required to accommodate the increased use, and antennas capable of handling the additional different frequency bands are desired.

FIG. 1 illustrates a conventional half-wave dipole antenna 100. The antenna 100 includes a radiator element 102 and a ground element 104. The radiator element 102 and the ground element 104 are connected to, and fed by, a signal feed 106. Each of the radiator element 102 and the ground element 104 has an electrical length of about one quarter of the wavelength ($\lambda/4$) of a signal at a desired resonant frequency of the antenna. Together, the radiator element 102 and the ground element 104 have a combined electrical length of about one half of the wavelength ($\lambda/2$) 108 of signals at one desired resonant frequency of the antenna 100.

In addition, omnidirectional antennas are useful for a variety of wireless communication devices because the radiation pattern allows for good transmission and reception from a mobile unit. Generally, an omnidirectional antenna is an antenna that radiates power generally uniformly in one plane with a directive pattern shape in a perpendicular plane, where the pattern is often described as "donut shaped."

One type of omnidirectional antenna is a collinear antenna. Collinear antennas are relatively high gain antennas that are used as external antennas for wireless local area network (WLAN) applications, such as wireless modems, etc. This is because collinear antennas have relative high gain and omnidirectional gain patterns.

Collinear antennas consist of in-phase arrays of radiating elements to enhance the gain performance. But collinear antennas are limited in that they are only operable as single band high gain antennas. By way of example, FIG. 2 illustrates a conventional collinear antenna 200 including upper and lower radiator elements 202, 204 each having an electrical length of about one half of the wavelength ($\lambda/2$) of a signal at a desired resonant frequency of the antenna.

In order to achieve high gain for more than a single band, however, back-to-back dipoles may be placed on opposite sides of a printed circuit board. For example, FIGS. 3 through 5 illustrate a conventional antenna 300 having back-to-back dipoles such that the antenna 300 is operable over two bands, specifically the 2.45 gigahertz band (from 2.4 gigahertz to 2.5 gigahertz) and the 5 gigahertz band (from 4.9 gigahertz to 5.875 gigahertz). For this conventional antenna 300, there are an upper pair of dipoles 302, 304 operating on the 2.45 gigahertz band and two lower pairs (1×2 array) of dipoles 306, 308, 310, 312 operating on the 5 gigahertz band. FIG. 3 illustrates the dipoles 302, 306, 308 on the front of the printed circuit board (PCB) 314, while FIG. 5 illustrates the dipoles 304, 310, 312 on the back of the PCB 314. The antenna 300 also includes microstrip line or feeding network 316 with a power divider to feed and divide the power to each of the various antenna elements.

SUMMARY

This section provides a general summary of the disclosure, and is not a comprehensive disclosure of its full scope or all of its features.

Disclosed herein are various exemplary embodiments of omnidirectional multi-band antennas. In an exemplary embodiment, an antenna includes upper and lower portions. The upper portion includes one or more upper radiating elements, one or more tapering features, and one or more slots configured to enable multi-band operation of the antenna. The lower portion includes one or more lower radiating elements and one or more slots.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 22:
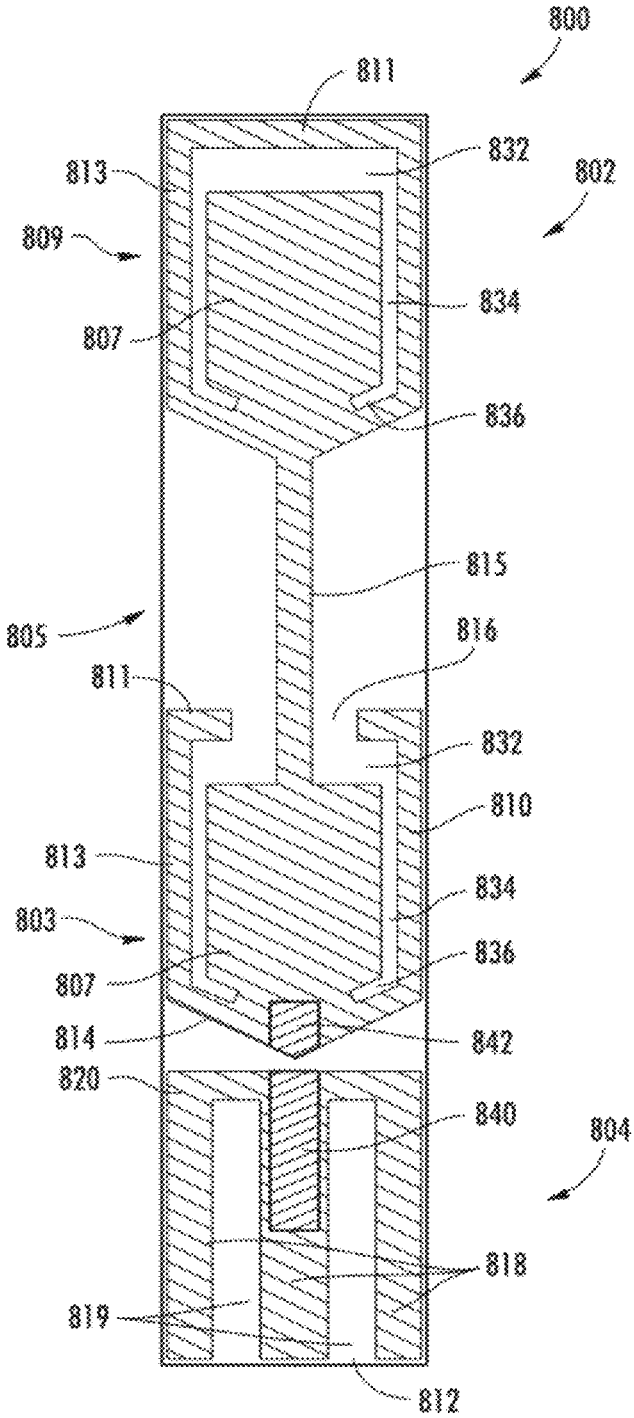
FIG. 22 illustrates another example embodiment of an omnidirectional multi-band antenna including one or more aspects of the present disclosure.
Figure 26:
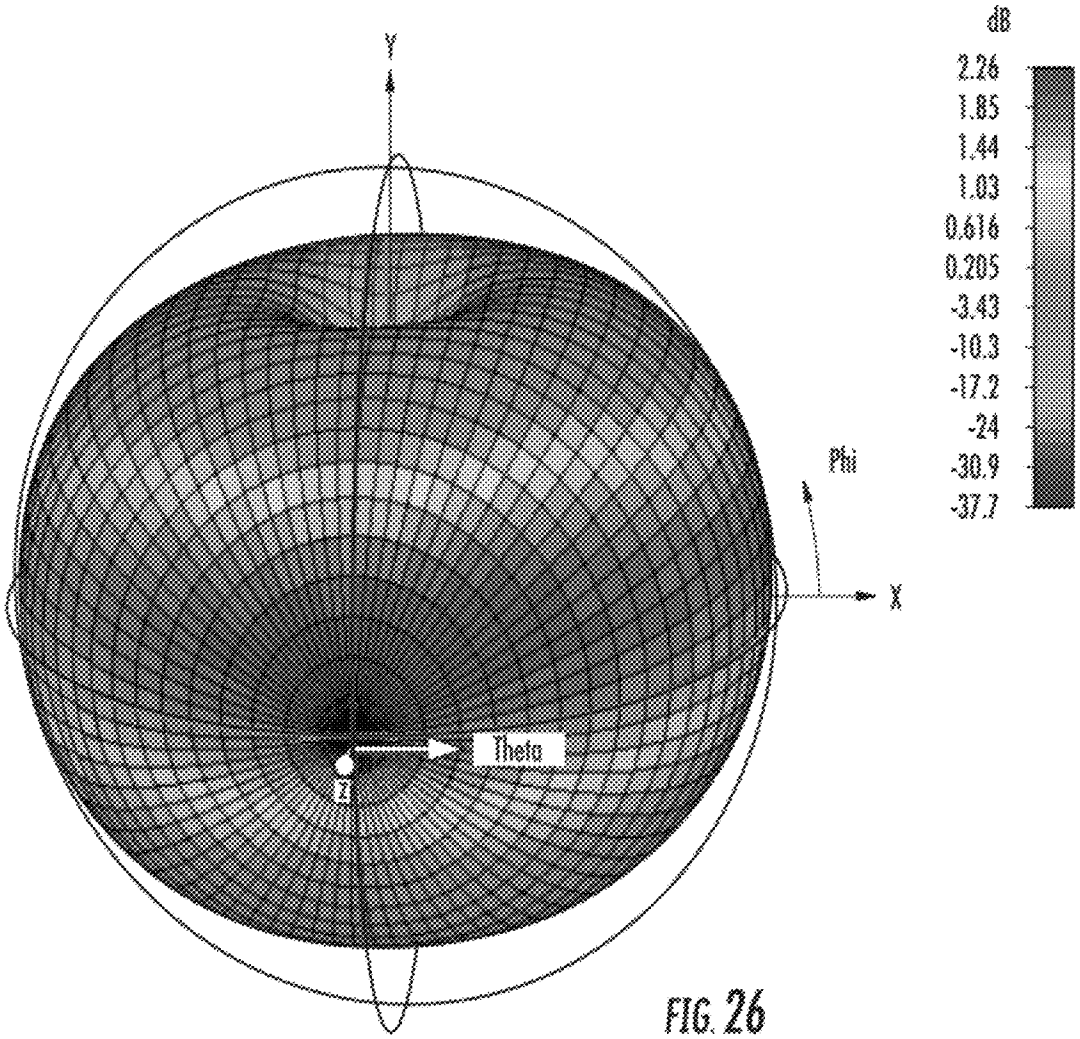
Figure 27:
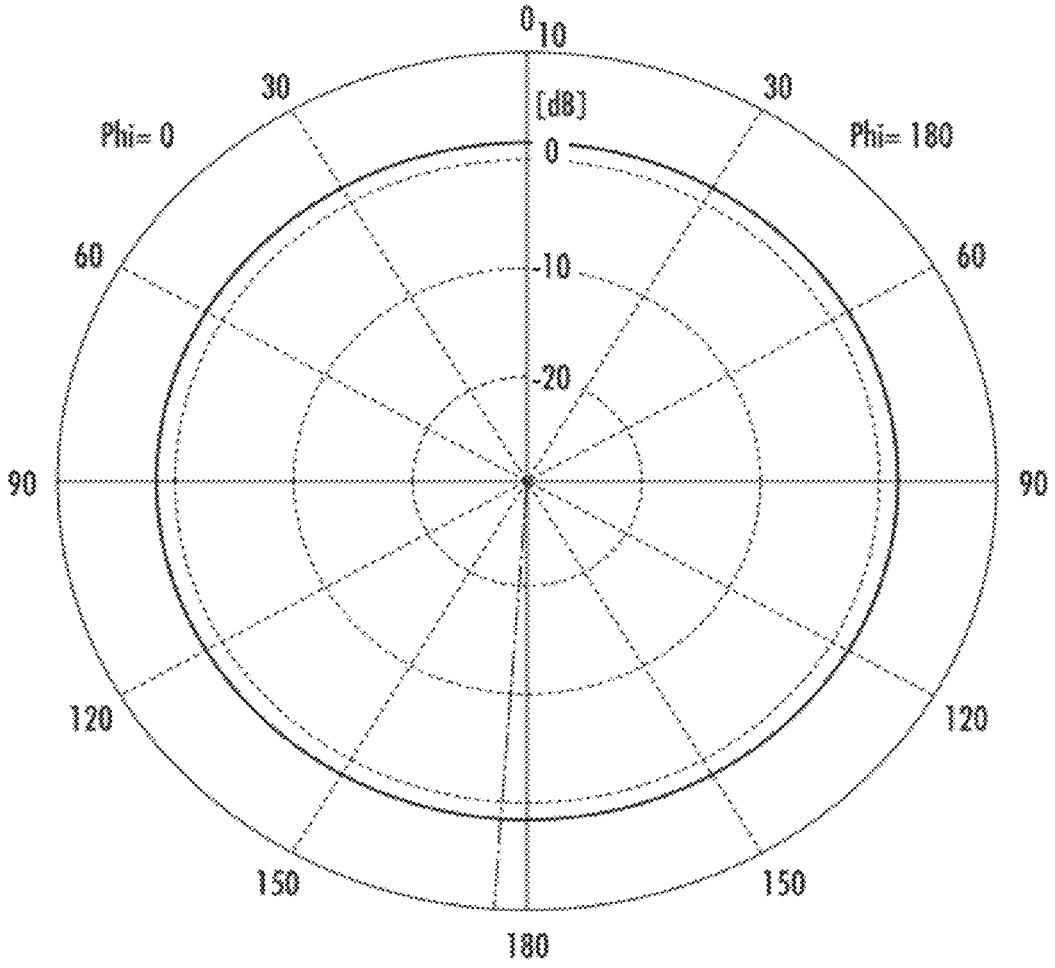
Figure 28:
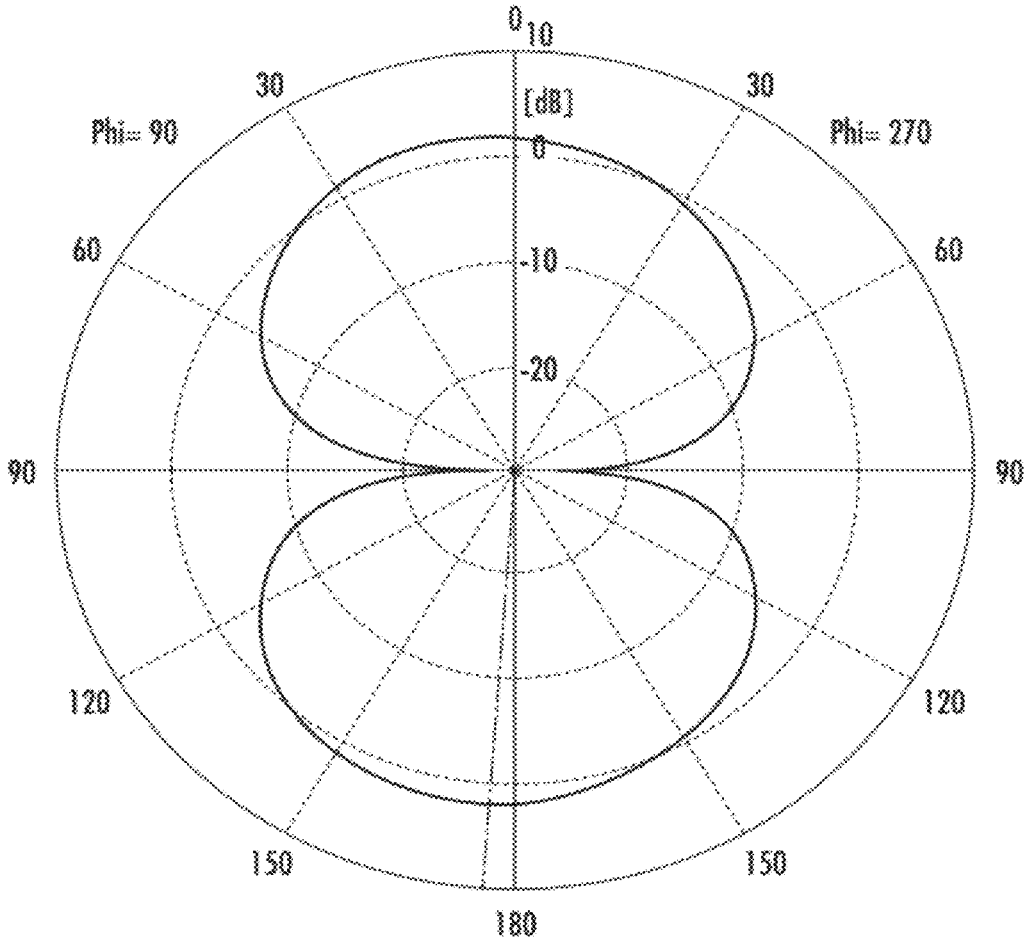
Figure 29:
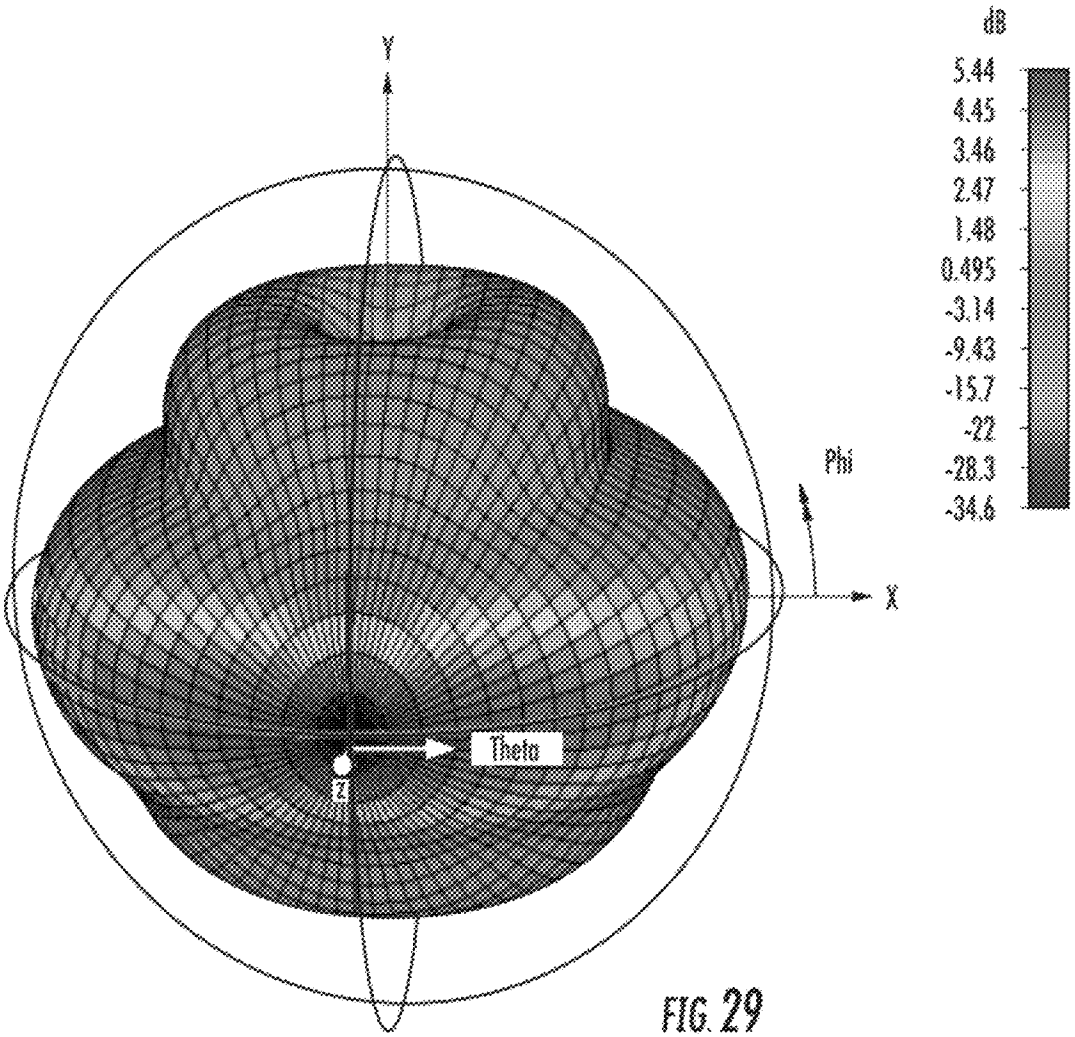
Figure 30:
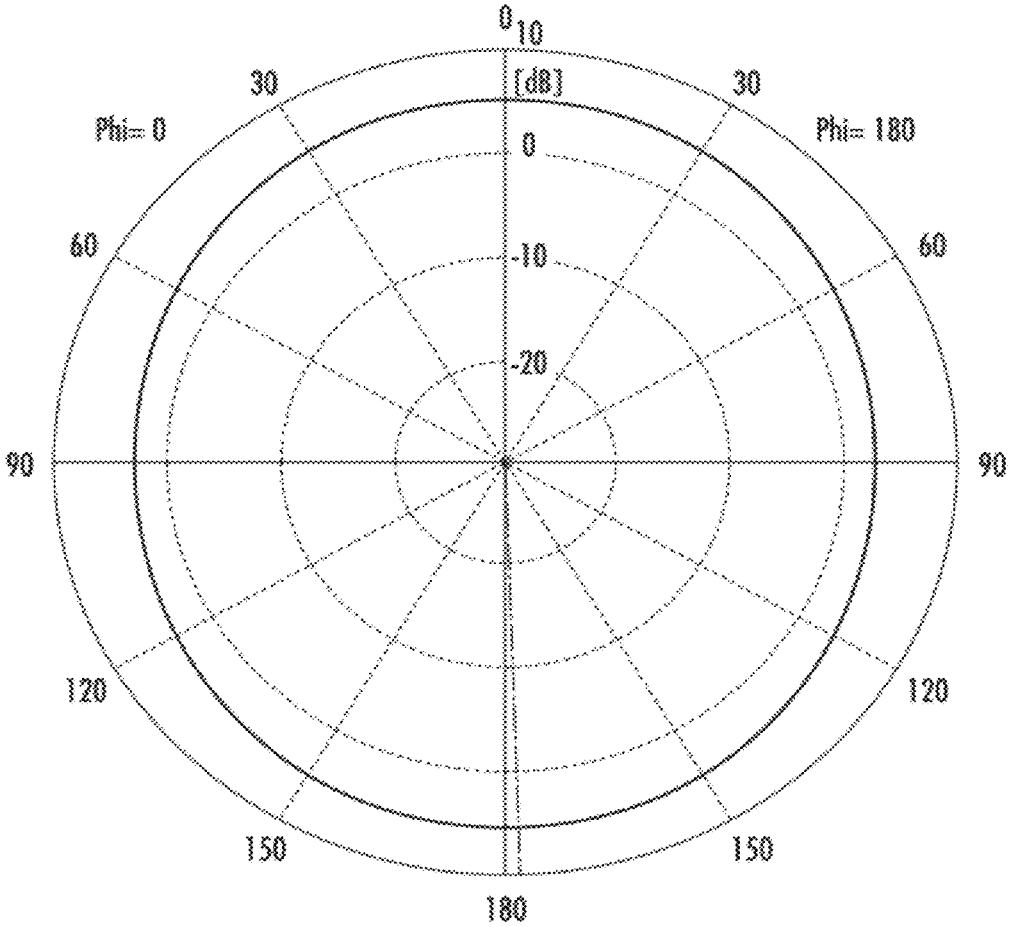
Figure 31:
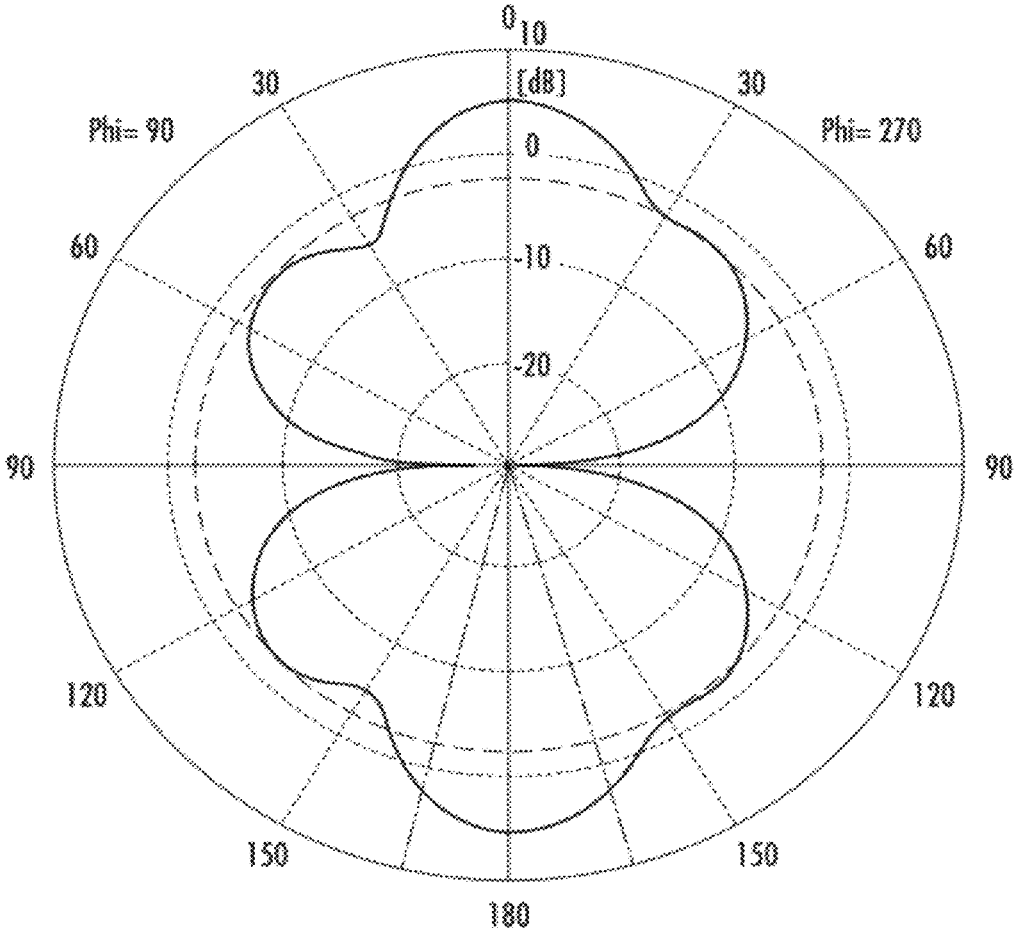
Figure 32:
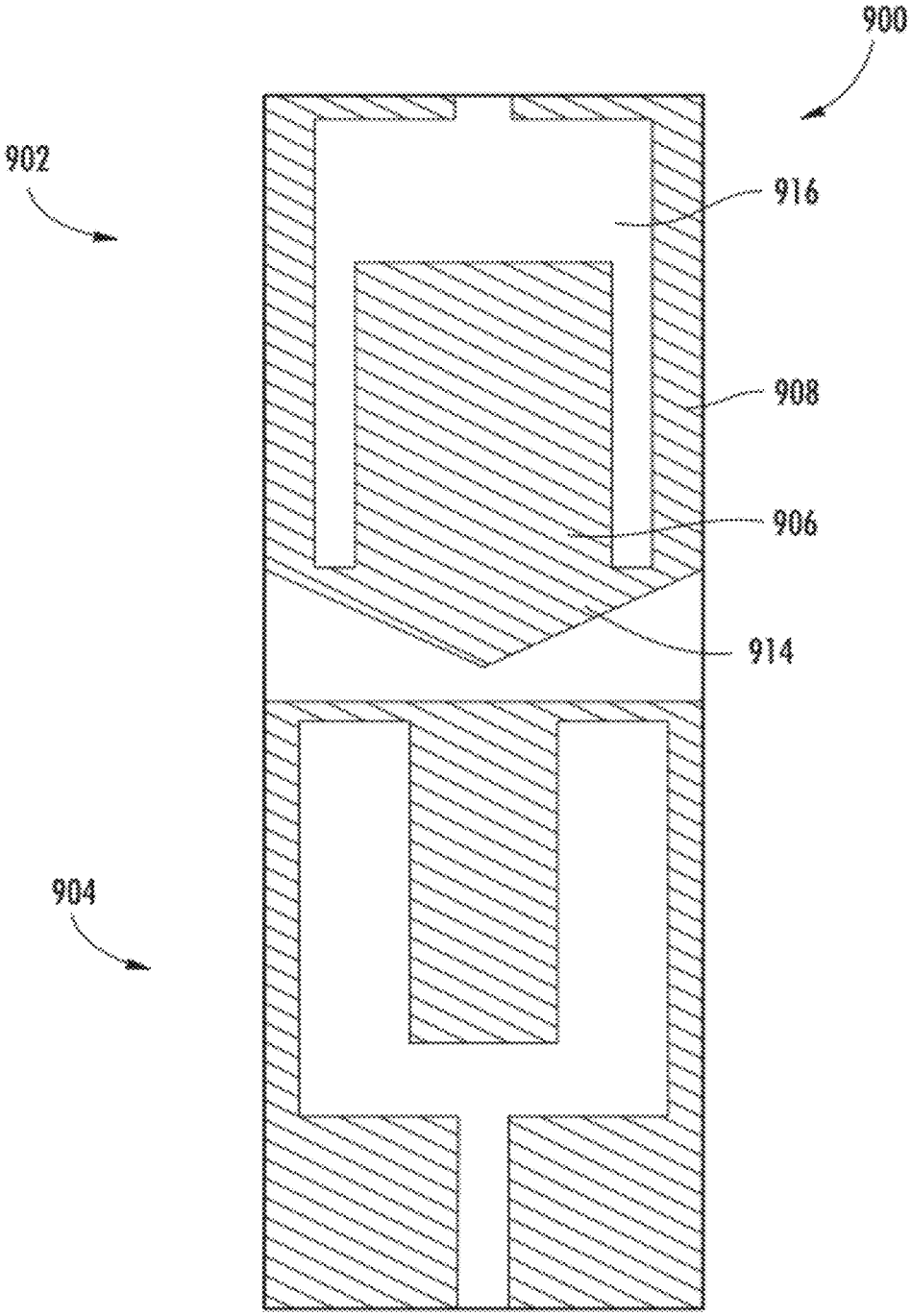
Figure 33:
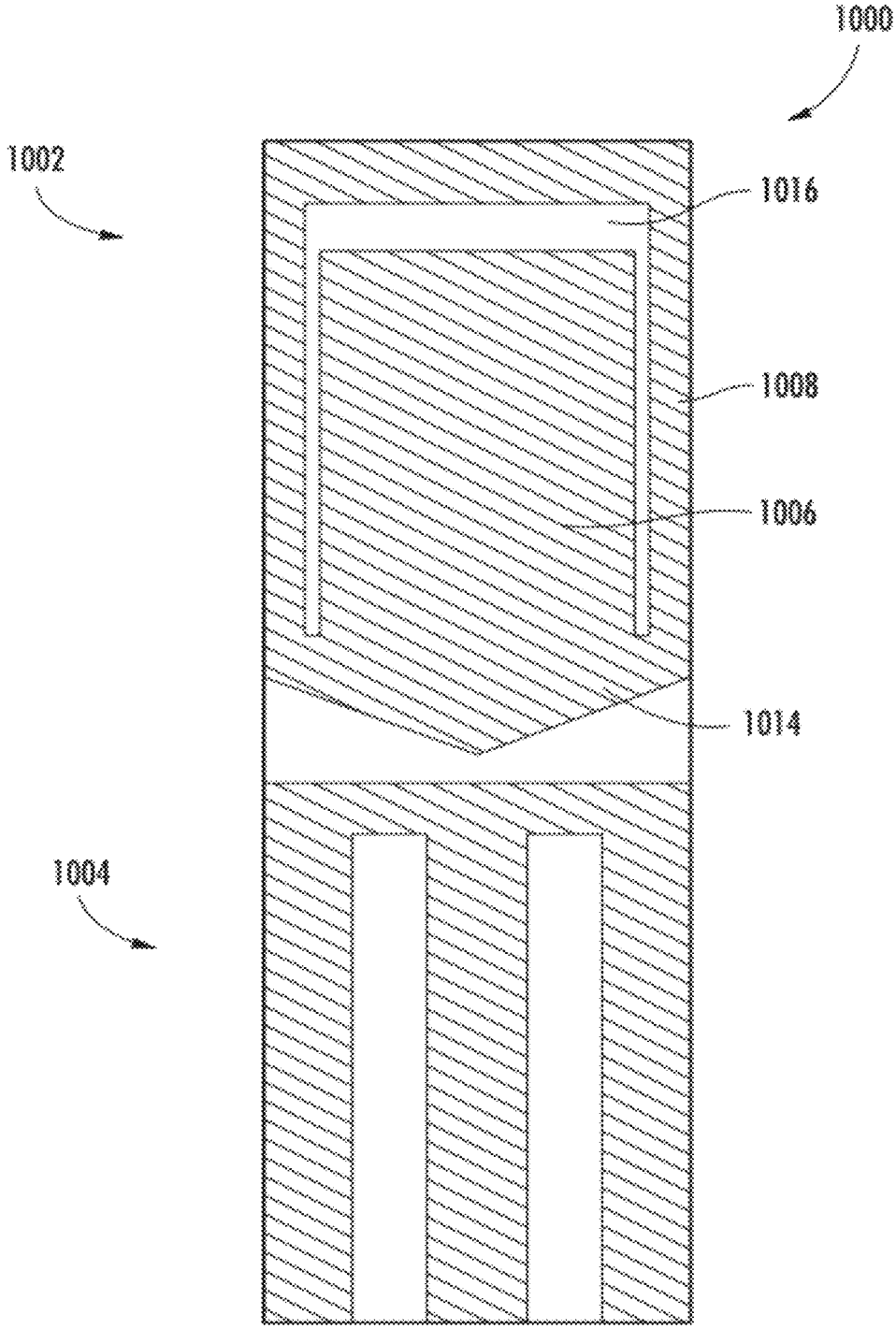
Figure 34:
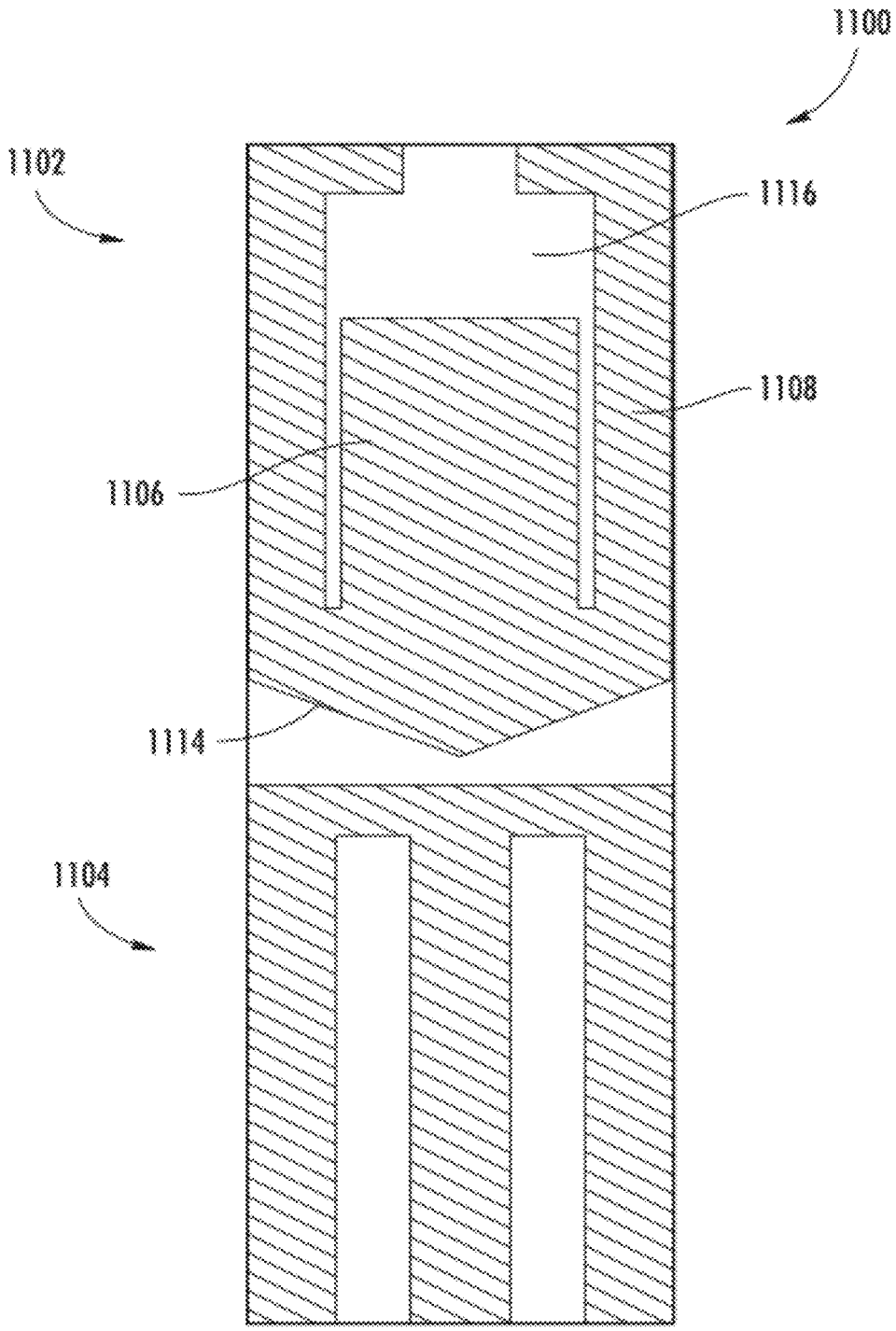
Figure 35:
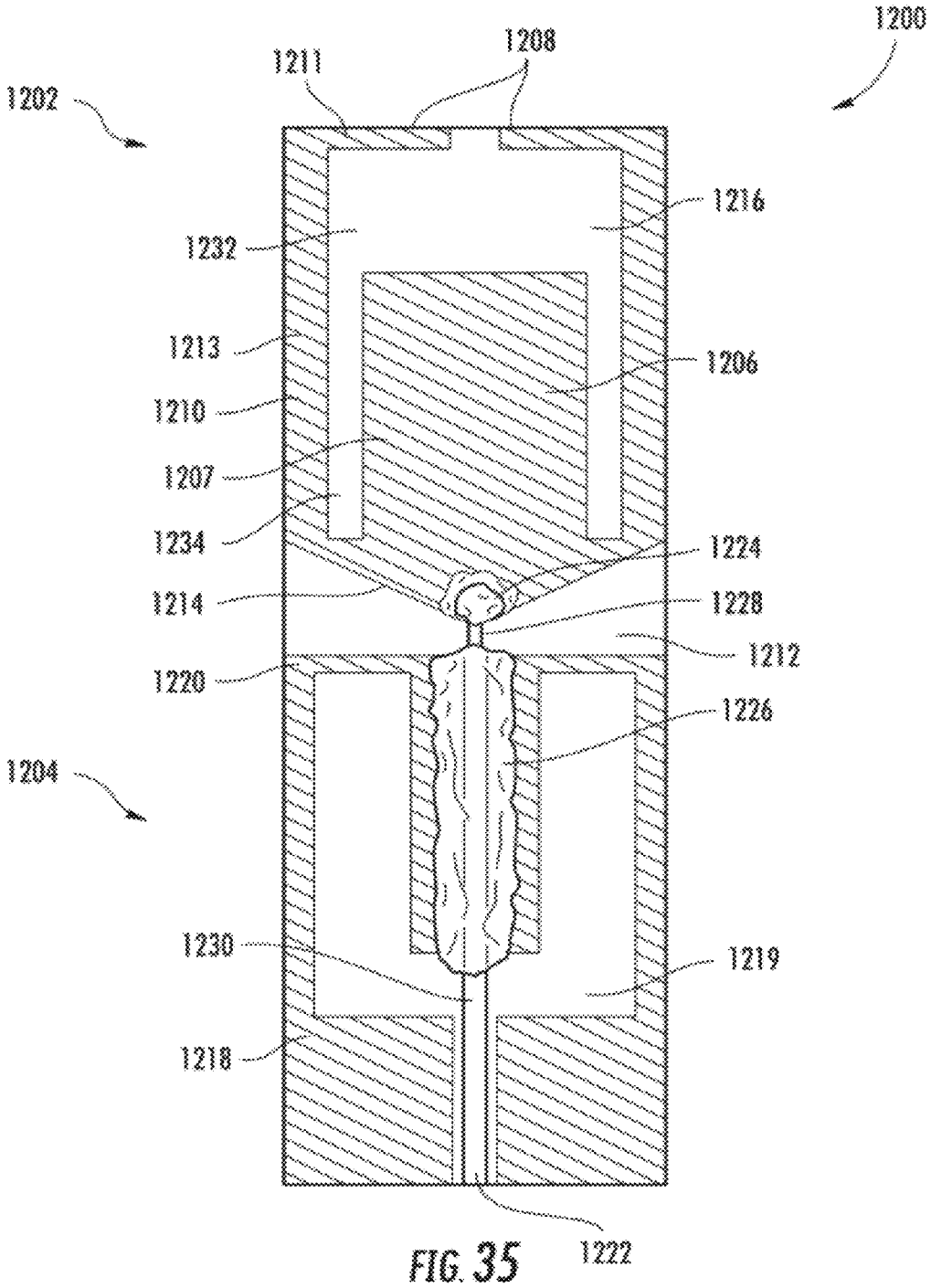
Figure 36:
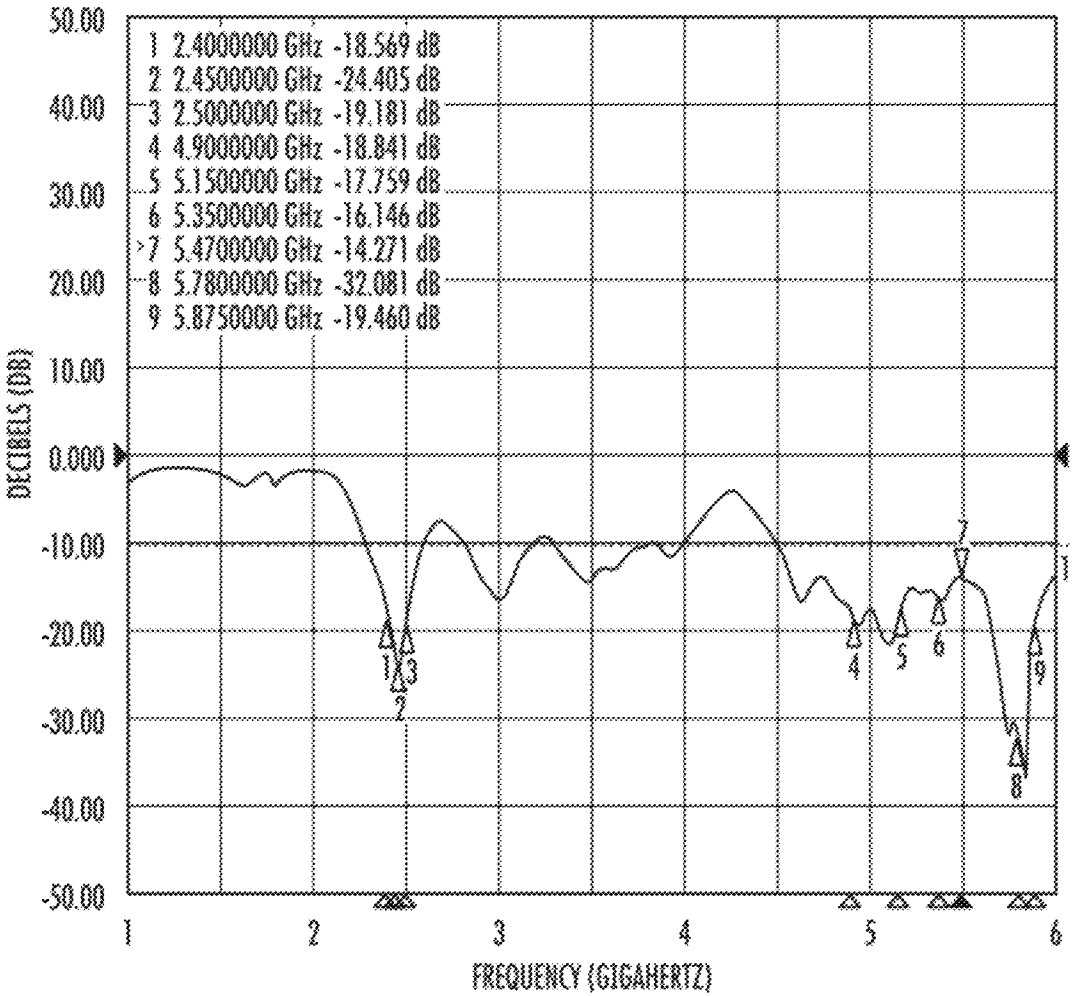
Figure 37:
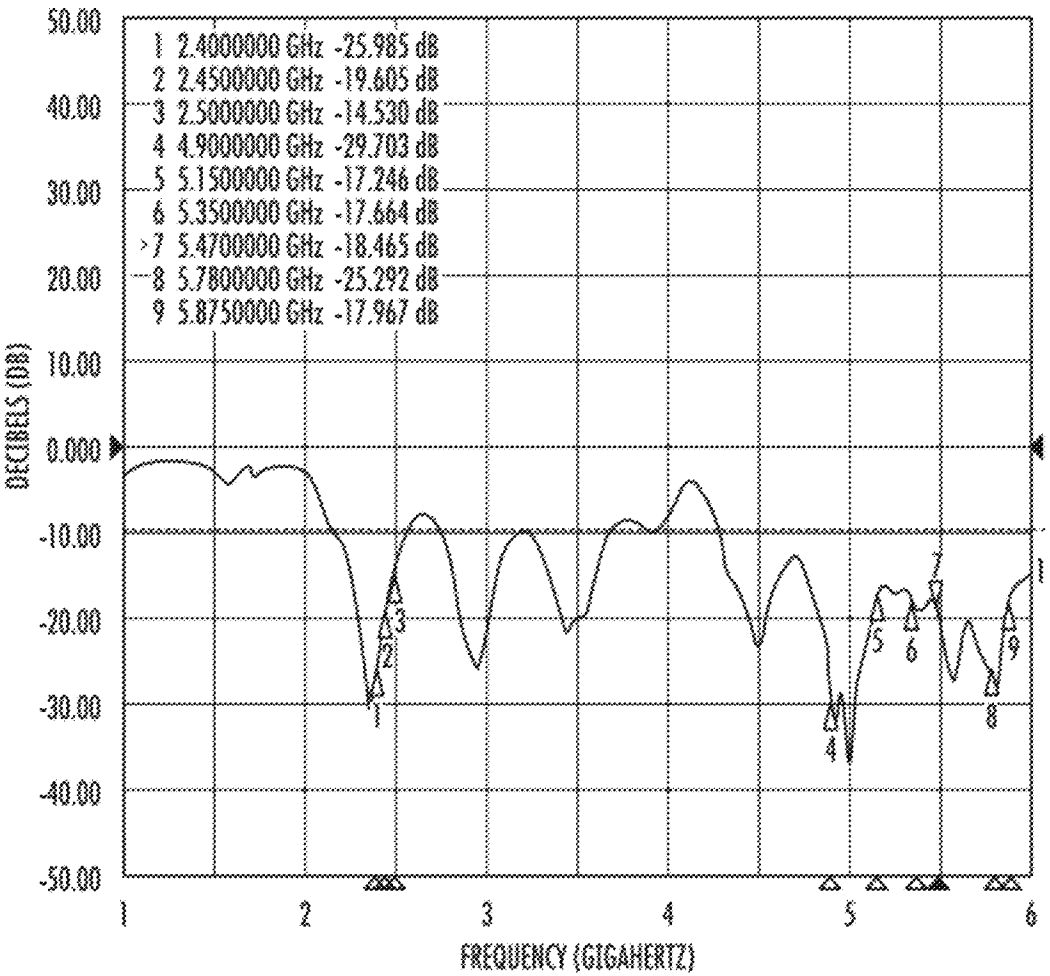
Figure 38:
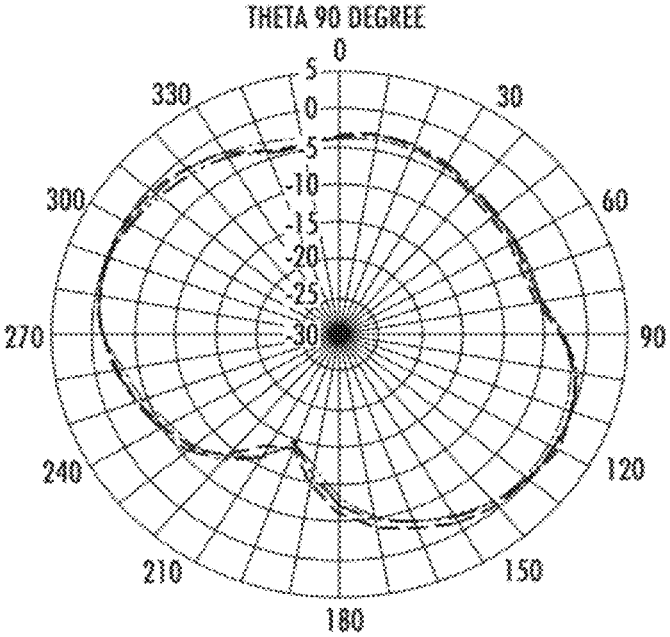
Figure 39:
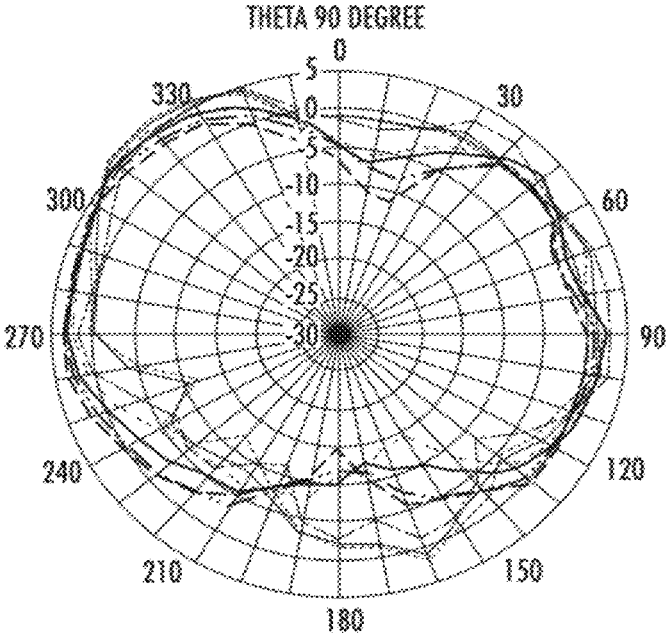
Figure 40:
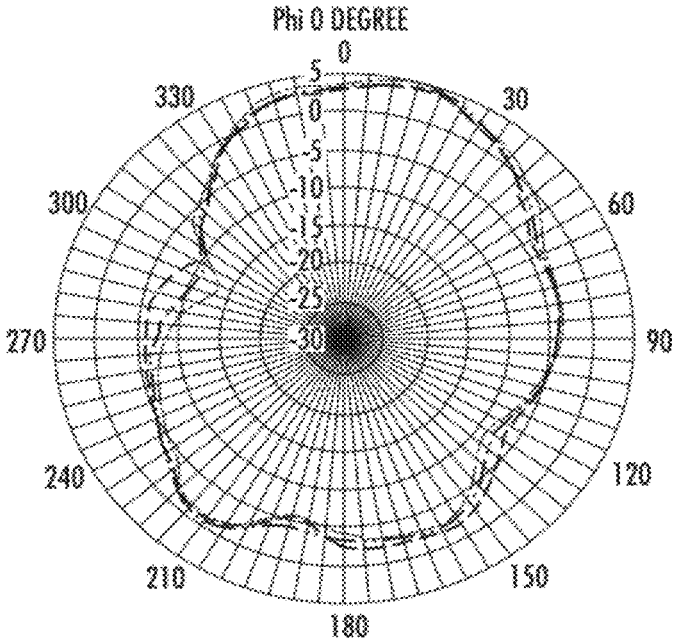
Figure 41:
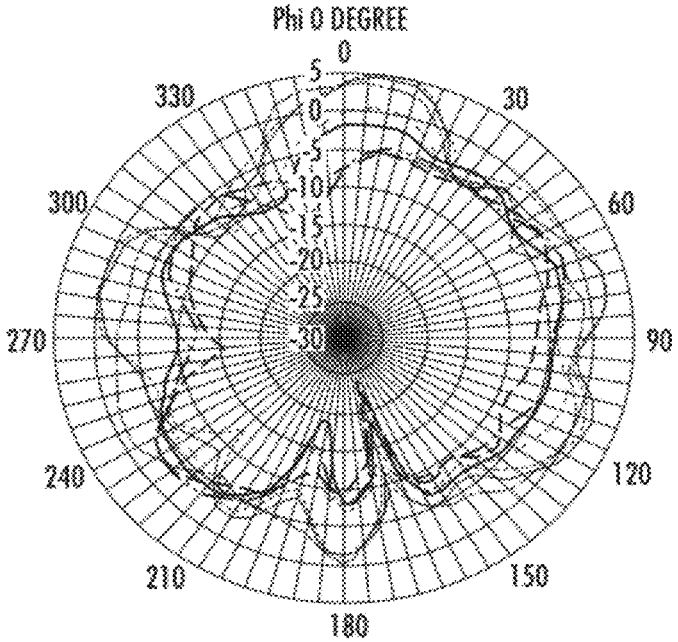
Figure 42:
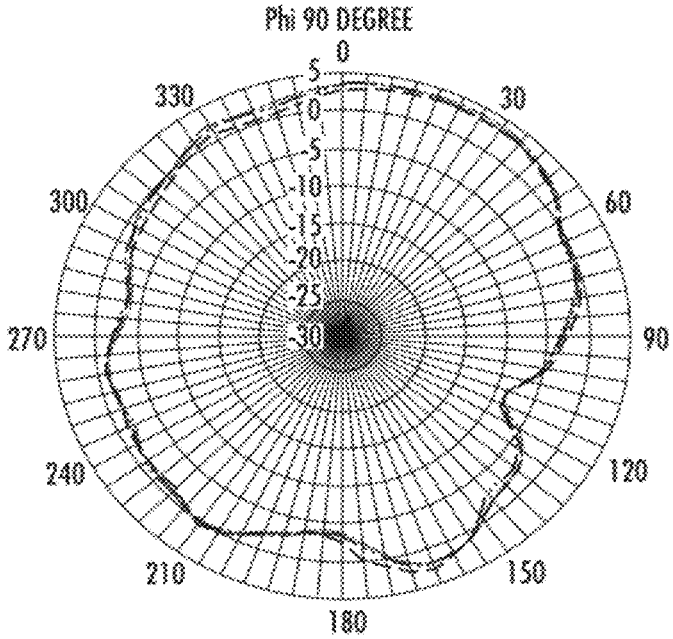
Figure 43:
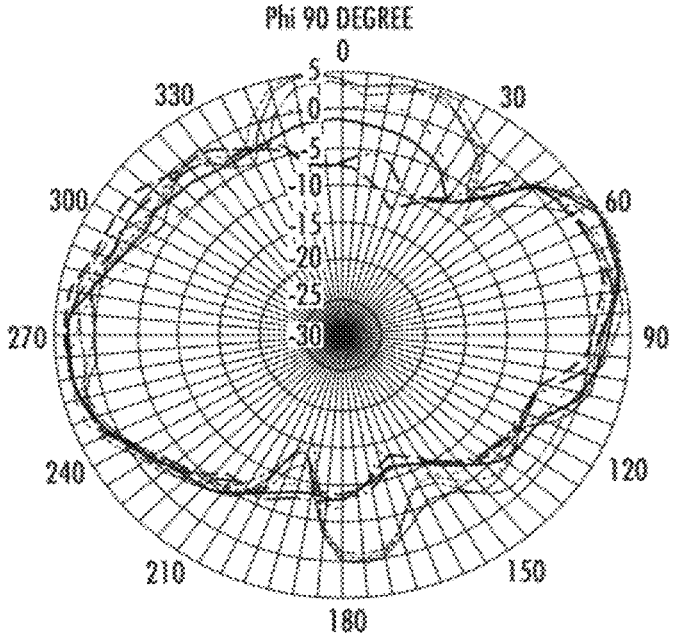

FIG. 26 illustrates computer-simulated far field realized gain in decibels for the example omnidirectional multi-band antenna shown in FIG. 22 at a frequency of 2.45 gigahertz, where the total efficiency was −0.2961 decibels and realized gain was 2.258 decibels, thereby indicating that the omnidirectional multi-band antenna shown in FIG. 22 is essentially operable as or similar to a standard half wavelength dipole antenna at the frequency of 2.45 gigahertz;

FIG. 27 illustrates computer-simulated azimuth radiation patterns (azimuth plane, theta 90 degree) for the example omnidirectional multi-band antenna shown in FIG. 22 for a frequency of 2.45 gigahertz;

FIG. 28 illustrates computer-simulated zero degree elevation radiation patterns (phi zero degree plane) for the example omnidirectional multi-band antenna shown in FIG. 22 for a frequency of 2.45 gigahertz;

FIG. 29 illustrates computer-simulated far field realized gain in decibels for the example omnidirectional multi-band antenna shown in FIG. 22 at a frequency of 5.5 gigahertz, where the total efficiency was −0.1980 decibels and realized gain was 5.441 decibels, thereby indicating that the omnidirectional multi-band antenna shown in FIG. 22 is essentially operable as or similar to a collinear dipole antenna array antenna having high gain properties at the frequency of 5.5 gigahertz;

FIG. 30 illustrates computer-simulated azimuth radiation patterns (azimuth plane, theta 90 degree) for the example omnidirectional multi-band antenna shown in FIG. 22 for a frequency of 5.5 gigahertz;

FIG. 31 illustrates computer-simulated zero degree elevation radiation patterns (phi zero degree plane) for the example omnidirectional multi-band antenna shown in FIG. 22 for a frequency of 5.5 gigahertz;

FIG. 32 is another example embodiment of an omnidirectional multi-band antenna including one or more aspects of the present disclosure;

FIG. 33 is another example embodiment of an omnidirectional multi-band antenna including one or more aspects of the present disclosure;

FIG. 34 is another example embodiment of an omnidirectional multi-band antenna including one or more aspects of the present disclosure;

FIG. 35 illustrates an exemplary prototype of an omnidirectional multi-band antenna according to another exemplary embodiment including one or more aspects of the present disclosure;

FIG. 36 is a line graph illustrating return loss in decibels measured for the prototype antenna shown in FIG. 35 operating in free space over a frequency range of 1 gigahertz to 6 gigahertz;

FIG. 37 is a line graph illustrating return loss in decibels measured for the prototype antenna shown in FIG. 35 operating at load with plastic cover over a frequency range of 1 gigahertz to 6 gigahertz;

FIG. 38 illustrates azimuth radiation patterns (azimuth plane, theta 90 degree) measured for the prototype antenna shown in FIG. 35 for frequencies of 2400 megahertz, 2450 megahertz, and 2500 megahertz;

FIG. 39 illustrates azimuth radiation patterns (azimuth plane, theta 90 degree) measured for the prototype antenna shown in FIG. 35 for frequencies of 4900 megahertz, 5150 megahertz, 5350 megahertz, 5470 megahertz, 5710 megahertz, 5780 megahertz, and 5850 megahertz;

FIG. 40 illustrates zero degree elevation radiation patterns (phi zero degree plane) measured for the prototype antenna shown in FIG. 35 for frequencies of 2400 megahertz, 2450 megahertz, and 2500 megahertz;

FIG. 41 illustrates zero degree elevation radiation patterns (phi zero degree plane) measured for the prototype antenna shown in FIG. 35 for frequencies of 4900 megahertz, 5150 megahertz, 5350 megahertz, 5470 megahertz, 5710 megahertz, 5780 megahertz, and 5850 megahertz;

FIG. 42 illustrates elevation radiation patterns (phi 90 degree) measured for the prototype antenna shown in FIG. 35 for frequencies of 2400 megahertz, 2450 megahertz, and 2500 megahertz; and FIG. 43 illustrates elevation radiation patterns (phi 90 degree) measured for the prototype antenna shown in FIG. 35 for frequencies of 4900 megahertz, 5150 megahertz, 5350 megahertz, 5470 megahertz, 5710 megahertz, 5780 megahertz, and 5850 megahertz.

DETAILED DESCRIPTION

Example embodiments will now be described more fully with reference to the accompanying drawings.

Figure 1:
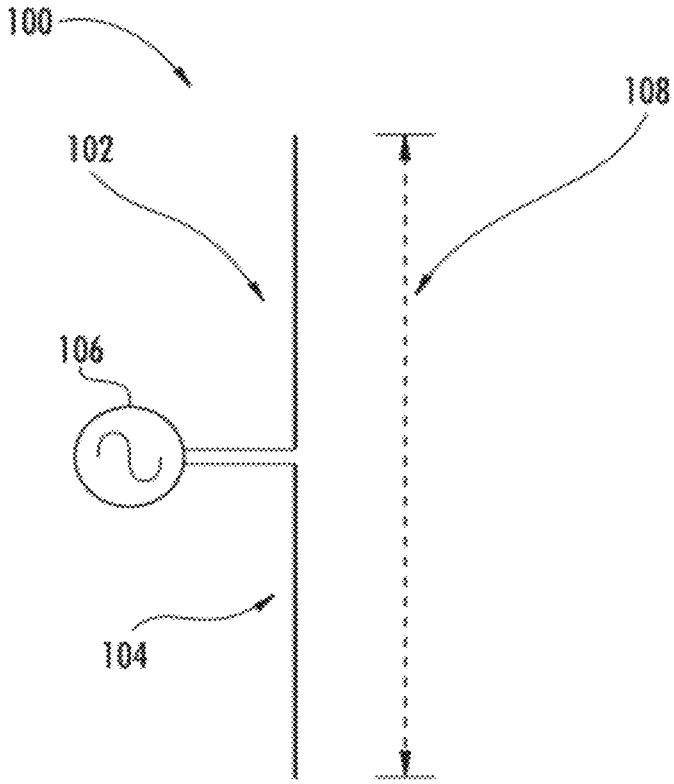
FIG. 1 is a conventional dipole antenna.
Figure 2:
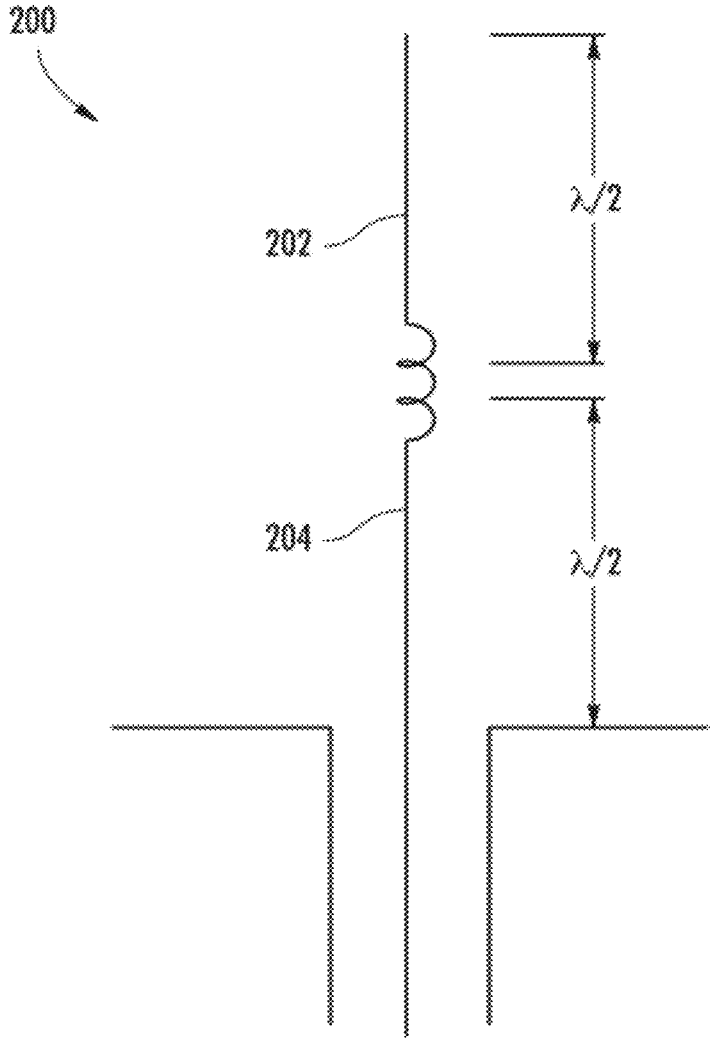
FIG. 2 is a conventional collinear antenna.
Figure 3:
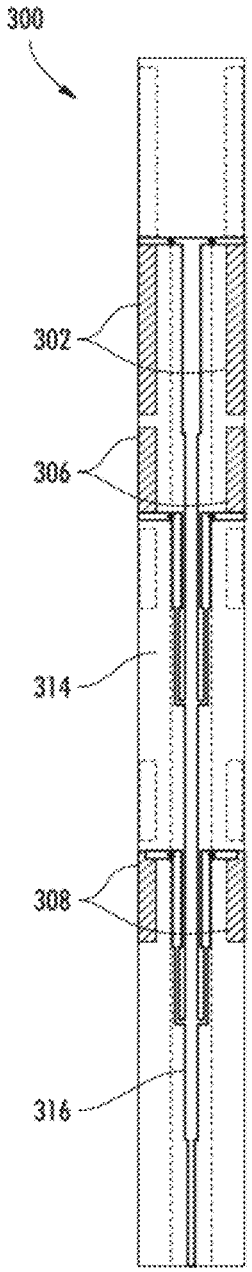
FIG. 3 is a front view of a conventional back-to-back dipole antenna.
Figure 4:
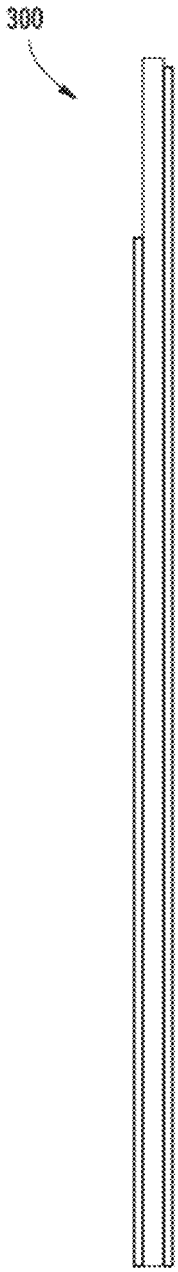
FIG. 4 is a side view of the conventional back-to-back dipole antenna shown in FIG. 3.
Figure 5:
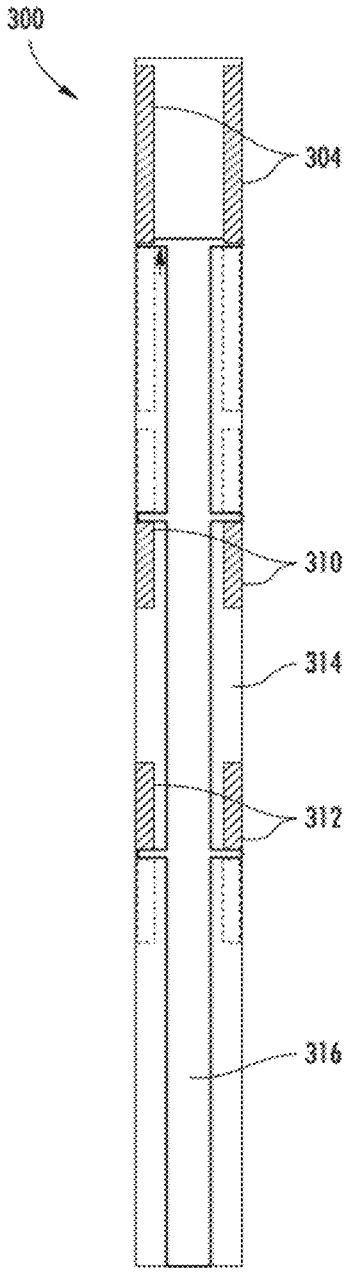
FIG. 5 is a back view of the conventional back-to-back dipole antenna shown in FIG. 3.
Figure 6:
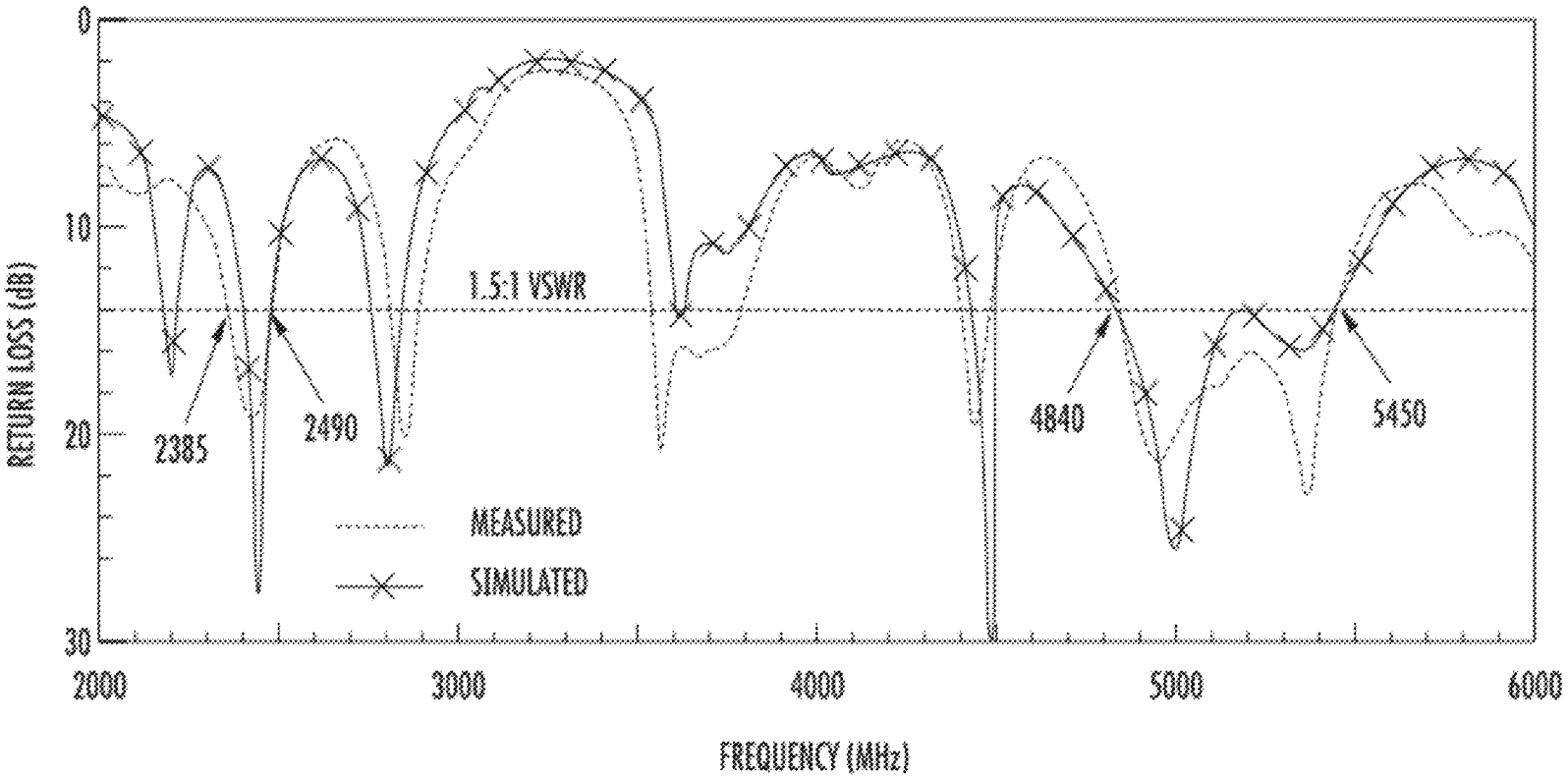
FIG. 6 is a line graph illustrating return loss in decibels for the conventional back-to-back dipole antenna shown in FIGS. 3 through 5 over a frequency range of 2000 megahertz to 6000 megahertz.

With reference to FIG. 6, there is shown the measured and computer-simulated return loss in decibels for the conventional back-to-back dipole antenna 300 (discussed above and shown in FIGS. 3 through 5) over a frequency range of 2000 megahertz to 6000 megahertz. In FIG. 6, the dashed horizontal line represents a Voltage Standing Wave Ratio of 1.5:1. In addition, the antenna 200 also had a gain level of about 2.5 in decibels referenced to isotropic gain (dBi) for the 2.45 gigahertz band (2.4 gigahertz to 2.5 gigahertz) , a gain level of about 4.0 dBi for a frequency range of 4.84 gigahertz to 5.450 gigahertz, and an omnidirectional ripple of less than 2 dBi.

As recognized by the inventors hereof, the 4 dBi gain of the conventional antenna 300 for the 5 gigahertz band, however, may not be high enough for some applications. The inventors hereof have also recognized that the back-to-back dipole arrangement also necessitates a double-sided printed circuit board 314 and a relatively long antenna due to having separate, spaced-2.45 gigahertz and 5 gigahertz band elements. For example, the conventional antenna 300 shown in FIGS. 3 through 5 included printed circuit board 314 having a length of about 160 millimeters and a width of about 12 millimeters. Accordingly, the inventors hereof have disclosed various exemplary embodiments of multi-band omnidirectional antennas (e.g., antenna 400 (FIG. 7), antenna 500 (FIG. 14), antenna 600 (FIG. 15), antenna 700 (FIG. 16), antenna 800 (FIG. 22), antenna 900 (FIG. 32), antenna 1000 (FIG. 33), antenna 1100 (FIG. 34), antenna 1200 (FIG. 35)) in which the radiating elements may be disposed on one side of a printed circuit board. Having the radiating elements on the same side of the printed circuit board may improve manufacturability as compared to the more difficult to manufacture back-to-back dipole antennas that utilize a double-sided printed circuit board having dipole elements on the front and back sides of the printed circuit board. Some embodiments may achieve high gain and/or have comparable or better performance than the conventional dipole antenna 300 shown in FIGS. 3 through 5.

The inventors have recognized that the antenna radiation pattern may squint downward without properly tuned slots. Accordingly, the inventions hereof disclose various embodiments of antennas having slots that are carefully tuned so as to help inhibit the antenna radiation pattern from squinting downward and/or also to help make the radiation patterns tilt at horizontal. In addition, disclosed herein are exemplary antennas (e.g., antenna 400 (FIG. 7), antenna 500 (FIG. 14), antenna 600 (FIG. 15), antenna 900 (FIG. 32), antenna 1000 (FIG. 33), antenna 1100 (FIG. 34), antenna 1200 (FIG. 35), etc.) that may be configured such that the antennas are operable at the 2.45 gigahertz band essentially as or similar to a standard half wavelength dipole antenna and operable at the 5 gigahertz band essentially as or similar to a wavelength dipole antenna. Also disclosed herein are exemplary antennas (e.g., antenna 700 (FIG. 16), antenna 800 (FIG. 22)) that may be configured such that the antennas are operable at the 2.45 gigahertz band essentially as or similar to a wavelength dipole antenna and operable at the 5 gigahertz band essentially as or similar to collinear array antenna.

Figure 7:
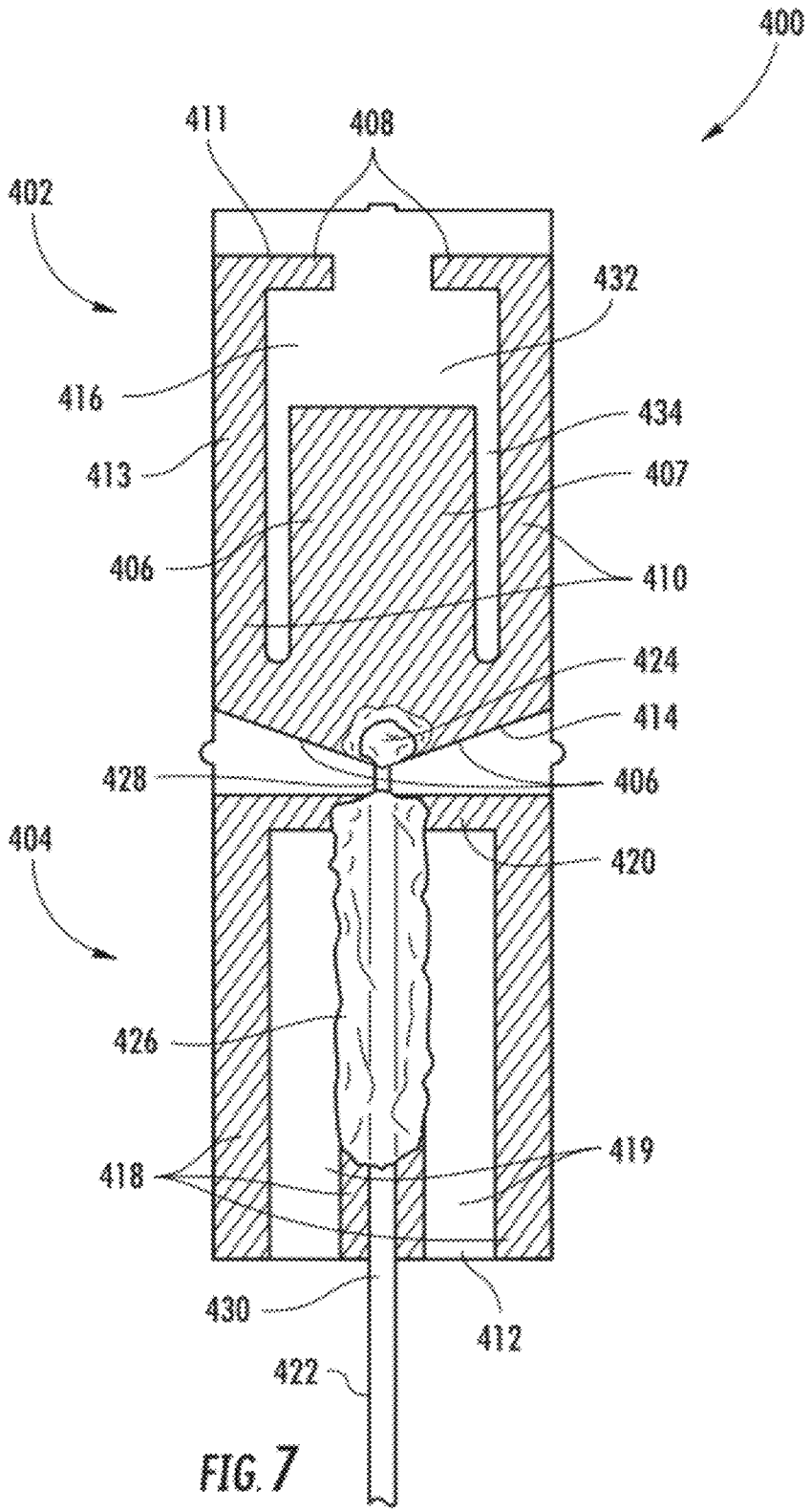
FIG. 7 illustrates an example embodiment of an omnidirectional multi-band antenna including one or more aspects of the present disclosure, in which a coaxial cable is coupled to the antenna.

Referring now to FIG. 7, there is shown an example embodiment of an omnidirectional multi-band antenna 400 including one or more aspects of the present disclosure. The antenna 400 includes upper and lower portions 402, 404 configured such that the antenna 400 is operable essentially as or similar to a standard half wavelength dipole antenna at a first frequency range (e.g., the 2.45 gigahertz band from 2.4 gigahertz to 2.5 gigahertz, etc.) with the upper and lower portions 402, 404 each having an electrical length of about λ/4. But at a second frequency range or high band (e.g., the 5 gigahertz band from 4.9 gigahertz to 5.875 gigahertz, etc.), the antenna 400 is operable essentially as or similar to a wavelength dipole antenna with the upper and lower portions 1202, 1204 each having an electrical length of about λ/2.

At the first frequency range, the antenna 400 may be operable such that the radiating element 408 has an electrical length of about λ/4. But the electrical length of the radiating element 406 at the first frequency range may be relatively small such that the radiating element 406 should not really be considered an effective radiating element at the first frequency range. Accordingly, only radiating element 408 is essentially radiating at the first frequency range. At the second frequency range or high band, both radiating elements 406, 408 are effective radiators with the radiating element 408 having an electrical wavelength of about λ/2 and the radiating element 406 having an electrical wavelength of about λ/4.

At the first and second frequency ranges, the lower portion 404 may be operable as ground, which permits the antenna 400 to be ground independent. Thus, the antenna 400 does not depend on a separate ground element or ground plane. At low band or the first frequency range (e.g., the 2.45 gigahertz band from 2.4 gigahertz to 2.5 gigahertz, etc.), the lower portion or planar skirt element 404 has an electrical length of about one quarter wavelength (λ/4). With the outer conductor 430 of coaxial cable 422 connected (e.g., soldered, etc.) to the planar skirt element 404, the planar skirt element 404 may behave as a quarter wavelength (λ/4) choke at low band or the first frequency range. In which case, the antenna current (or at least a portion thereof) does not leak into the outer surface of the coaxial cable 422. This allows the antenna 400 to operate essentially like a half wavelength dipole antenna (λ/2) at low band. At the second frequency range or high band (e.g., the 5 gigahertz band from 4.9 gigahertz to 5.875 gigahertz, etc.), the lower portion 404 has an electrical length of about λ/2, such that the lower portion 4044 may be considered more like a radiating element than a sleeve choke. This allows the antenna 400 to operate essentially like a wavelength dipole antenna (λ) at high band.

The antenna's upper portion 402 includes a tapering feature 414 for impedance matching. The illustrated tapering feature 414 is generally V-shaped (e.g., having a shape similar to the English alphabetic letter "v"). As shown in FIG. 7, the tapering feature 414 comprises the lower edge of the radiating elements of the antenna's upper portion 402 that is spaced apart from the lower portion 404 and oriented such that it is pointing generally at the middle of the connecting element 420 of the antenna's lower portion 404.

Slots 416 are introduced to configure upper radiating elements 406, 408, which help enable multi-band operation of the antenna 400. By way of example, the upper radiating elements 406, 408 and slots 416 may be configured such that the upper radiating elements 404, 406 are operable as low and high band elements (e.g., 2.45 gigahertz band and 5 gigahertz band, etc.), respectively. In the illustrated example, the slots 416 include a generally rectangular top portion 432 and two downwardly extending straight portions 434.

The slots disclosed herein (e.g., slots 416, 419, etc.) are generally an absence of electrically-conductive material between radiating elements. By way of example, an upper or lower antenna portion may be initially formed with the slots, or the slot may be formed by removing electrically-conductive material, such as by etching, cutting, stamping, etc. In still yet other embodiments, slots may be formed by an electrically nonconductive or dielectric material, which is added to the planar radiator such as by printing, etc.

As shown in FIG. 7, the "high band" radiating element 406 includes a generally rectangular shaped portion 407 connected to the tapering feature 414 such that the rectangular portion 407 and tapering feature 414 cooperatively define an arrow shape. The "low" band radiating element 408 includes two L-shaped portions 410 (e.g., portions shaped like the English alphabetic capital letter "L") separated and spaced apart from the rectangular portion 407 of the "high band" radiating element 406 by the slot portions 432, 434. Each L-shaped portion 410 includes a straight portion 413 and an end portion 411 perpendicular to and extending inwardly from the straight portion 413. The straight portion 413 is connected to the tapering feature 414 and extends away from the tapering feature 414 in a direction opposite the lower portion 404 (upwardly in FIG. 7). Each straight portion 413 of the L-shaped portion 410 extends alongside and past the general rectangular portion 407 of the "high band" radiating element 406. The end portion 411 of each L-shaped portion 410 extends inwardly from the corresponding straight portion 413 toward the end portion 411 of the other L-shaped portion 410. The end portions 411 are aligned with each other but are spaced-apart from each other and the generally rectangular portion 407 of the "high band" radiating element 406 by slots 416. In addition, each end portion 411 extends inwardly from the corresponding straight portion 413 a sufficient distance such that each end portion 411 partially overlaps the width of the rectangular portion 407 of the "high band" radiating element 406.

Figure 8:
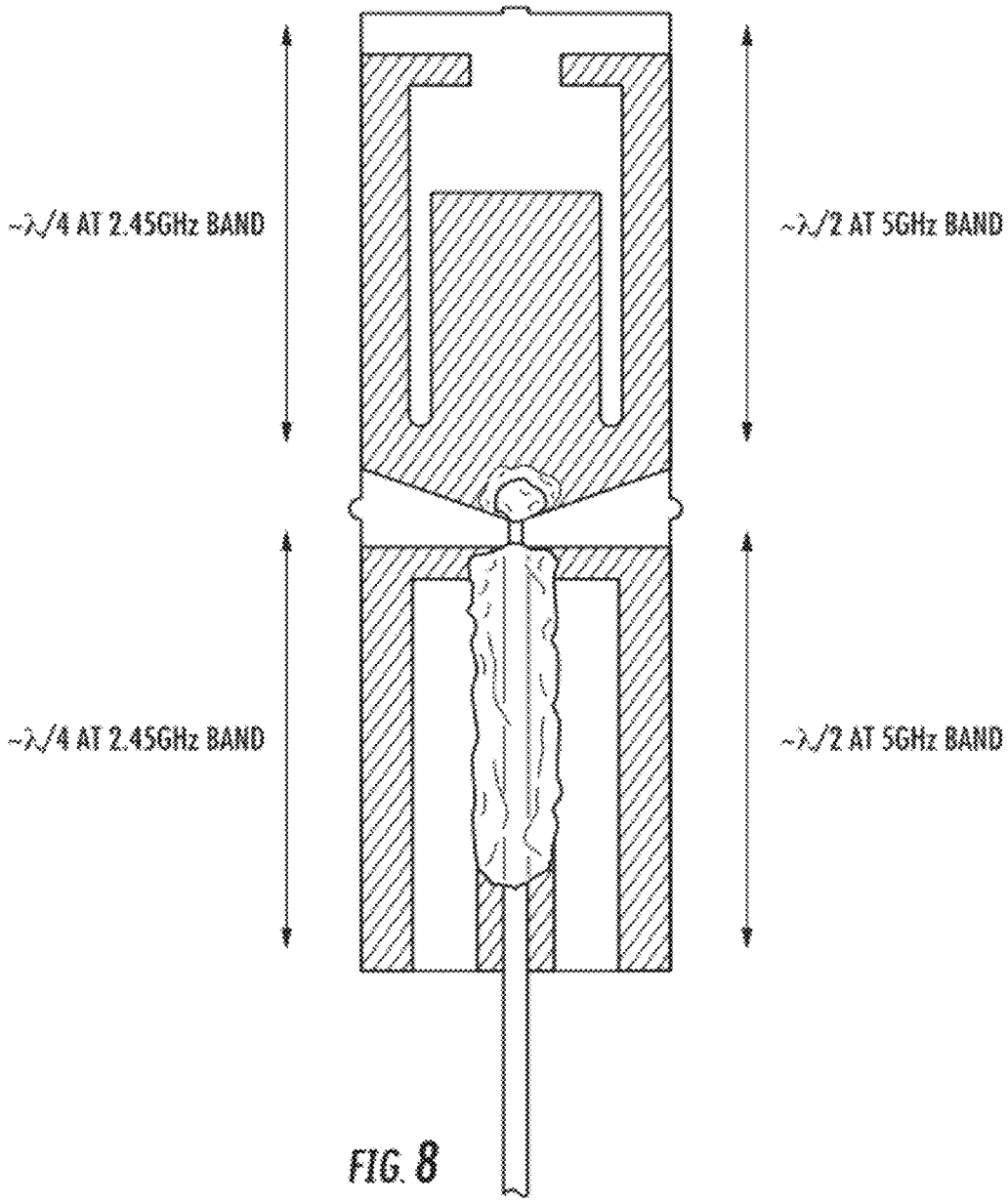
FIG. 8 illustrates the omnidirectional multi-band antenna shown in FIG. 7, and also illustrating the electrical lengths of the upper and lower portions of the antenna at the 2.45 gigahertz band and at the 5 gigahertz band where these electrical lengths are provided for purposes of illustration only according to exemplary embodiments.

In the particular embodiment shown in FIG. 8, the slots 416 may be carefully tuned so that the antenna 400 operates at high band (e.g., the 5 gigahertz band from 4.9 gigahertz to 5.875 gigahertz, etc.) with the upper and lower arms or portions 402, 404 each having an electrical length of about $\lambda/2$. But at low band (e.g., the 2.45 gigahertz band from 2.4 gigahertz to 2.5 gigahertz, etc.), the upper and lower arms or portions 402, 404 each have an electrical length of about $\lambda/4$. Alternative embodiments may include radiating elements, tapering features, and/or slots configured differently than that shown in FIGS. 7 *and* 8, such as for producing different radiation patterns at different frequencies and/or for tuning to different operating bands.

The inventors have recognized that the antenna radiation pattern may squint downward without properly tuned slots. Accordingly, the inventions hereof disclose various embodiments of antennas having slots that are carefully tuned so as to help inhibit the antenna radiation pattern from squinting downward and/or also to help make the radiation patterns tilt at horizontal.

As shown in FIG. 7, the lower portion 404 (which may also be referred to as a planar skirt element) includes three elements 418. For this particular example, the three elements 418 comprise two outer radiating elements with ground element disposed between the two radiating elements. The two radiating elements are spaced apart from the ground element (e.g., by 3 millimeters, etc.) by slots 419. The two radiating elements and ground element are connected to a connecting element 420. The elements 418 are generally parallel with each other and extend generally perpendicular in a same direction (downward in FIG. 7) from the connecting element 420. The elements 418, 420 are generally rectangular in the illustrated embodiment. The elements 418, 420 may have identical lengths and/or widths, or they may have varied lengths and/or widths. For example, FIG. 7 illustrates the elements 418 having the same length (e.g., 20 millimeters, etc.) but the middle element 418 is wider than the two outer elements 418 (e.g., 3 millimeters wide, etc.). The dimensions in this paragraph are provided for purposes of illustration only and not for purposes of limitation, as alternative embodiments may include elements configured differently.

The upper and lower elements (e.g., 406, 408, 418, 420, etc.) disclosed herein may be made of electrically-conductive material, such as, for example, copper, silver, gold, alloys, combinations thereof, other electrically-conductive materials, etc. Further, the upper and lower elements may all be made out of the same material, or one or more may be made of a different material than the others. Still further, the "high band" radiating element (e.g., 406, etc.) may be made of a different material than the material from which the "low band" radiating element (e.g., 408, etc.) is formed. Similarly, the lower elements (e.g., 418, 420, etc.) may each be made out of the same material, different material, or some combination thereof. The materials provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

The antenna 400 may include feed locations or points (e.g., solder pads, etc.) for connection to a feed. In the illustrated example shown in FIG. 7, the feed is a coaxial cable 422 (e.g., IPEX coaxial connector, etc.) soldered 424, 426 to the feed points of the antenna 400. More specifically, an inner conductor 428 of the coaxial cable 422 is soldered 424 to the feed location adjacent and/or on a portion of the tapering feature 414 of the upper radiating portion 402. The outer conductor 430 of the coaxial cable 422 is soldered 426 to the connecting element 420 and/or middle element 418 of the skirt or lower portion 404. The outer conductor 430 may be soldered along a length of the middle element 418 (see, e.g., soldering pad 840 in FIG. 22, etc.) and/or directly to the substrate 412, for example, to provide additional strength and/or reinforcement to the connection of the coaxial cable 422. Alternative embodiments may include other feeding arrangements, such as other types of feeds besides coaxial cables and/or other types of connections besides soldering, such as snap connectors, press fit connections, etc.

As shown in FIG. 7, the upper and lower elements are all supported on the same side of a substrate 412. Accordingly, this illustrated embodiment of the antenna 400 allows the radiating elements to be on the same side, thus eliminating the need for a double-sided printed circuit board. The elements may be fabricated or provided in various ways and supported by different types of substrates and materials, such as a circuit board, a flexible circuit board, a plastic carrier, Flame Retardant 4 or FR4, flex-film, etc. In various exemplary embodiments, the substrate 412 comprises a flex material or dielectric or electrically non-conductive printed circuit board material. In embodiments in which the substrate 412 is formed from a relatively flexible material, the antenna 400 may be flexed or configured so as to follow the contour or shape of the antenna housing profile. The substrate 412 may be formed from a material having low loss and dielectric properties. According to some embodiments the antenna 400 may be, or may be part of a, printed circuit board (whether rigid or flexible) where the radiating elements are all conductive traces (e.g., copper traces, etc.) on the circuit board substrate. The antenna 400 thus may be a single sided PCB antenna. Alternatively, the antenna 400 (whether mounted on a substrate or not) may be constructed from sheet metal by cutting, stamping, etching, etc. The substrate 412 may be sized differently depending, for example, on the particular application as varying the thickness and dielectric constant of the substrate may be used to tune the frequencies. By way of example, the substrate 412 may have a length of about 45 millimeters, a width of about 16.6 millimeters, and a thickness of about 0.80 millimeters. Alternative embodiments may include a substrate with a different configuration (e.g., different shape, size, material, etc.). The materials and dimensions provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

FIGS. 9 through 13 illustrate measured analysis results for the omnidirectional multi-band antenna 400 shown in FIG. 7. These measured analysis results shown in FIGS. 9 through 13 are provided only for purposes of illustration and not for purposes of limitation. Generally, these results show that the omnidirectional multi-band antenna 400 is operable essentially as a dual band dipole in at least two frequency bands—a low band (e.g., the 2.45 gigahertz band from 2.4 gigahertz to 2.5 gigahertz, etc.) and a high band (e.g., the 5 gigahertz band from 4.9 gigahertz to 5.875 gigahertz, etc.).

Figure 9:
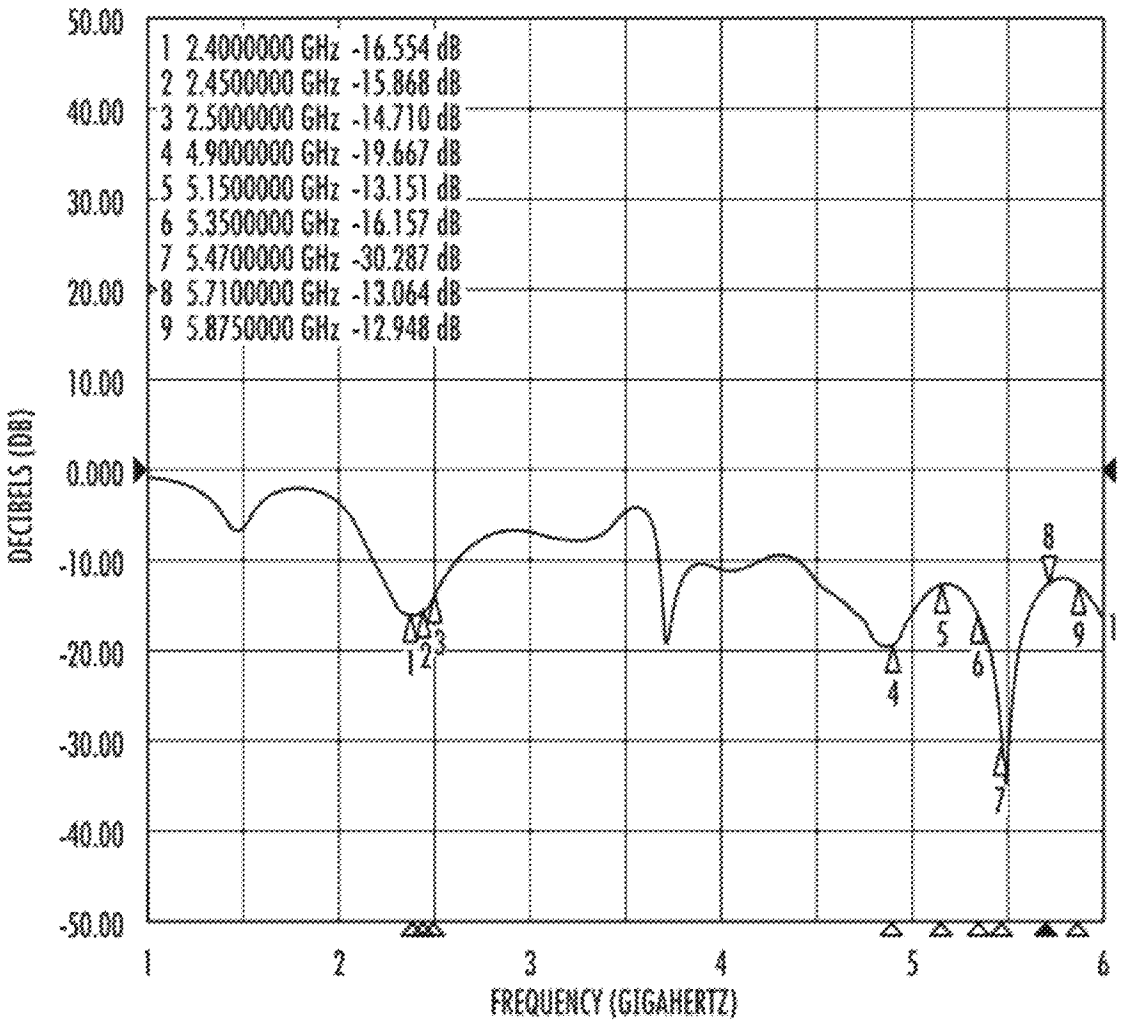
FIG. 9 is a line graph illustrating measured return loss in decibels for the example omnidirectional multi-band antenna shown in FIG. 7 over a frequency range of 1 gigahertz to 6 gigahertz.
Figure 10:
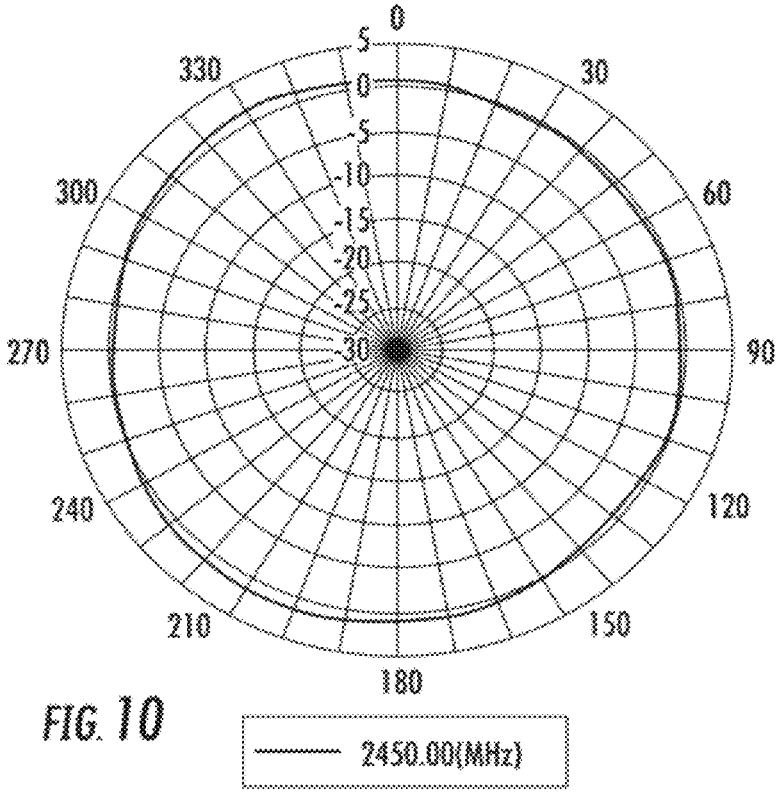
FIG. 10 illustrates measured azimuth radiation patterns (azimuth plane, theta 90 degree) for the example omnidirectional multi-band antenna shown in FIG. 7 for a frequency of 2450 megahertz.
Figure 11:
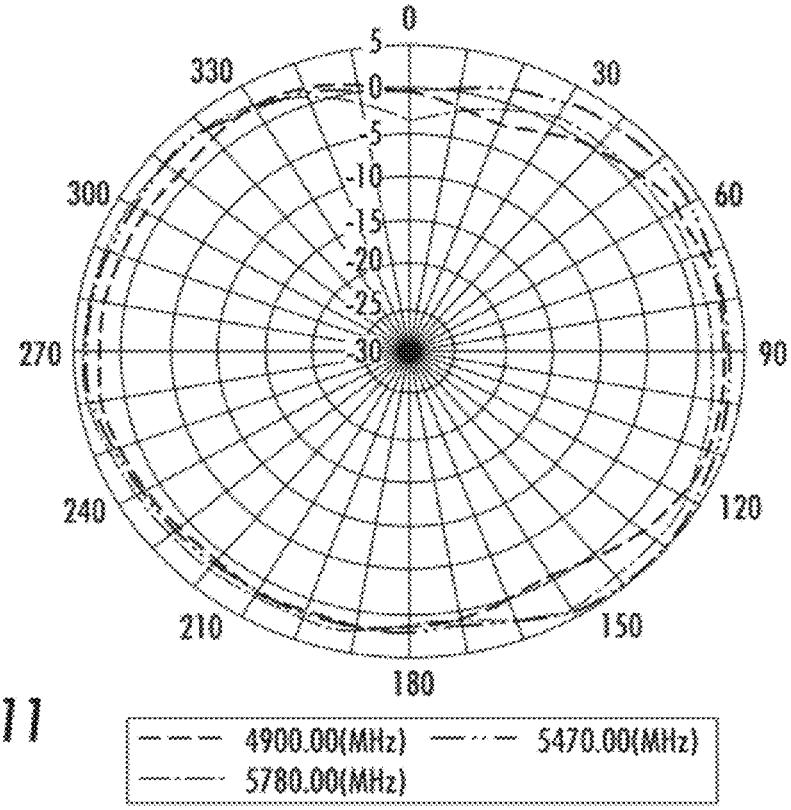
FIG. 11 illustrates measured azimuth radiation patterns (azimuth plane, theta 90 degree) for the example omnidirectional multi-band antenna shown in FIG. 7 for frequencies of 4900 megahertz, 5470 megahertz, and 5780 megahertz.
Figure 12:
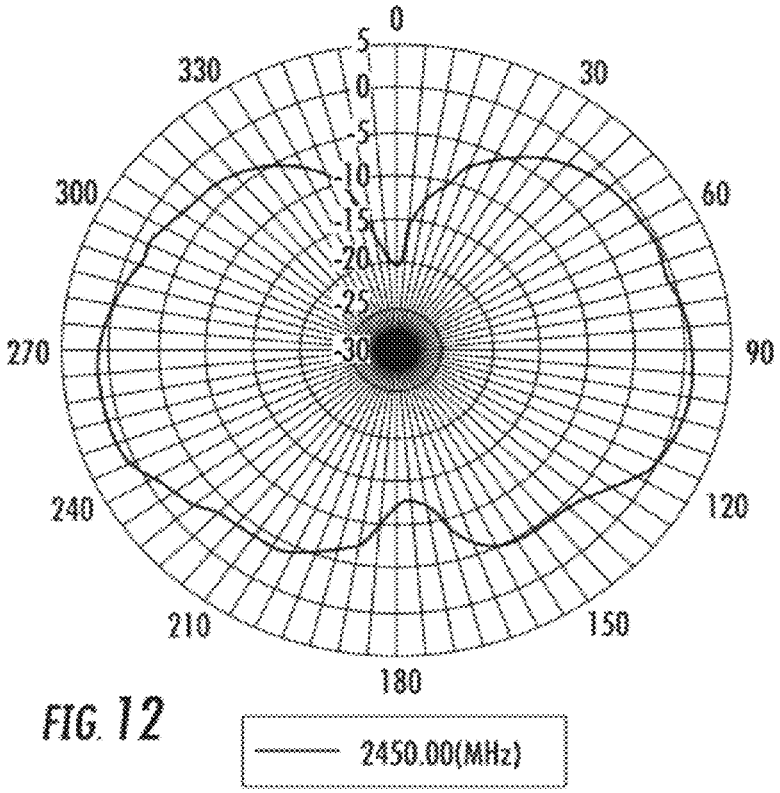
FIG. 12 illustrates measured zero degree elevation radiation patterns (phi zero degree plane) for the example omnidirectional multi-band antenna shown in FIG. 7 for a frequency of 2450 megahertz.
Figure 13:
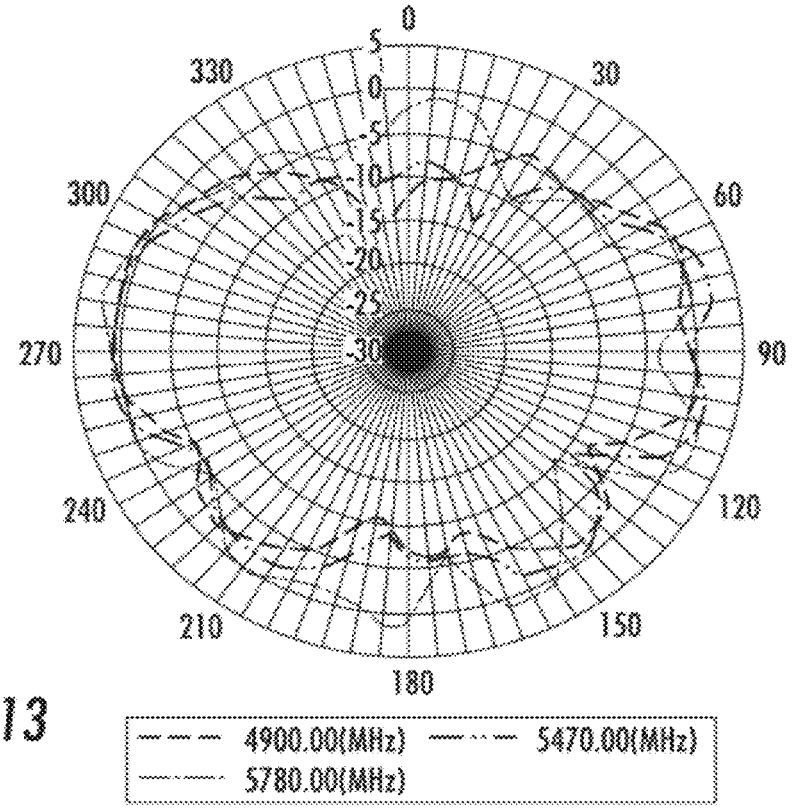
FIG. 13 illustrates measured zero degree elevation radiation patterns (phi zero degree plane) for the example omnidirectional multi-band antenna shown in FIG. 7 for frequencies of 4900 megahertz, 5470 megahertz, and 5780 megahertz.

More specifically, FIG. 9 is a line graph illustrating measured return loss in decibels for the antenna 400 over a frequency range of 1 gigahertz to 6 gigahertz. FIG. 10 illustrates measured azimuth radiation patterns (azimuth plane, theta 90 degree) for the antenna 400 for a frequency of 2450 megahertz. FIG. 11 illustrates measured azimuth radiation patterns (azimuth plane, theta 90 degree) for the antenna 400 for frequencies of 4900 megahertz, 5470 megahertz, and 5780 megahertz. FIG. 12 illustrates measured zero degree elevation radiation patterns (phi zero degree plane) for the antenna 400 for a frequency of 2450 megahertz. FIG. 13 illustrates measured zero degree elevation radiation patterns (phi zero degree plane) for the antenna 400 for frequencies of 4900 megahertz, 5470 megahertz, and 5780 megahertz.

The table 1 below provides measured performance data relating to gain and efficiency for the omnidirectional multi-band antenna 400 shown in FIG. 7. As shown, the antenna 400 may be configured to achieve about 2 dBi gain for the 2.45 gigahertz band and about 3 dBi to 6 dBi gain for the 5 gigahertz band. This exemplary embodiment of the antenna 400 may achieve such results with a relatively small size and be manufacturable relatively easily as compared to the manufacture of back-to-back dipole antennas that utilize a double-sided printed circuit board.

TABLE 1

Summary of Results for Antenna 400
Performance Summary Data

| Frequency (MHz) | 3D Efficiency | 3D Max Gain | Azimuth Max Gain | Azimuth Average Gain | Elevation 0 Max Gain | Elevation 0 Average Gain | Elevation 90 Max Gain | Elevation 90 Average Gain |
|---|---|---|---|---|---|---|---|---|
| 2400 | 84% | 1.91 | 1.36 | 0.71 | 1.31 | −4.60 | 1.31 | −4.60 |
| 2450 | 84% | 2.28 | 1.73 | 0.47 | 1.66 | −4.09 | 1.66 | −4.09 |
| 2500 | 78% | 1.94 | 1.42 | −0.21 | 1.75 | −3.94 | 1.75 | −3.94 |
| 4900 | 79% | 3.26 | 3.11 | 1.48 | 1.17 | −4.17 | 1.17 | −4.17 |
| 5150 | 74% | 3.29 | 3.12 | 1.38 | 1.20 | −4.67 | 1.20 | −4.67 |
| 5350 | 87% | 4.13 | 3.74 | 2.31 | 1.31 | −4.23 | 1.85 | −4.23 |
| 5470 | 96% | 5.11 | 4.42 | 2.79 | 2.65 | −3.81 | 2.65 | −3.81 |

TABLE 1-continued

Summary of Results for Antenna 400
Performance Summary Data

| Frequency (MHz) | 3D Efficiency | 3D Max Gain | Azimuth Max Gain | Azimuth Average Gain | Elevation 0 Max Gain | Elevation 0 Average Gain | Elevation 90 Max Gain | Elevation 90 Average Gain |
|---|---|---|---|---|---|---|---|---|
| 5710 | 96% | 5.00 | 4.10 | 1.20 | 3.77 | −1.57 | 3.77 | −1.57 |
| 5780 | 99% | 5.00 | 4.17 | 2.03 | 2.50 | −2.25 | 2.50 | −2.25 |
| 5875 | 94% | 6.25 | 2.71 | 0.48 | 5.16 | −1.38 | 2.50 | −1.38 |

Figure 15:
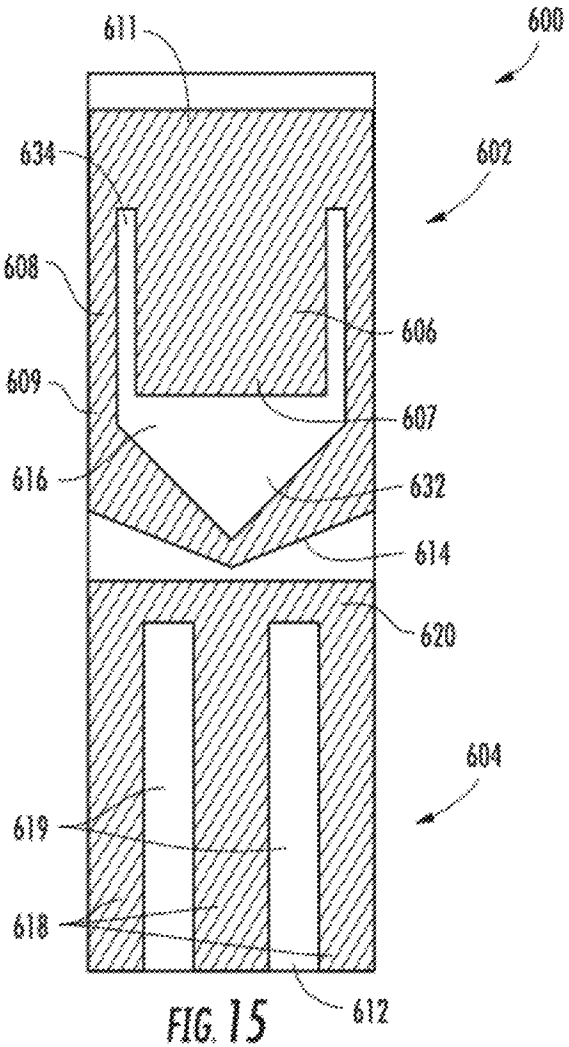
FIG. 15 is a plan view of another example embodiment of a omnidirectional multi-band antenna including one or more aspects of the present disclosure.
Figure 14:
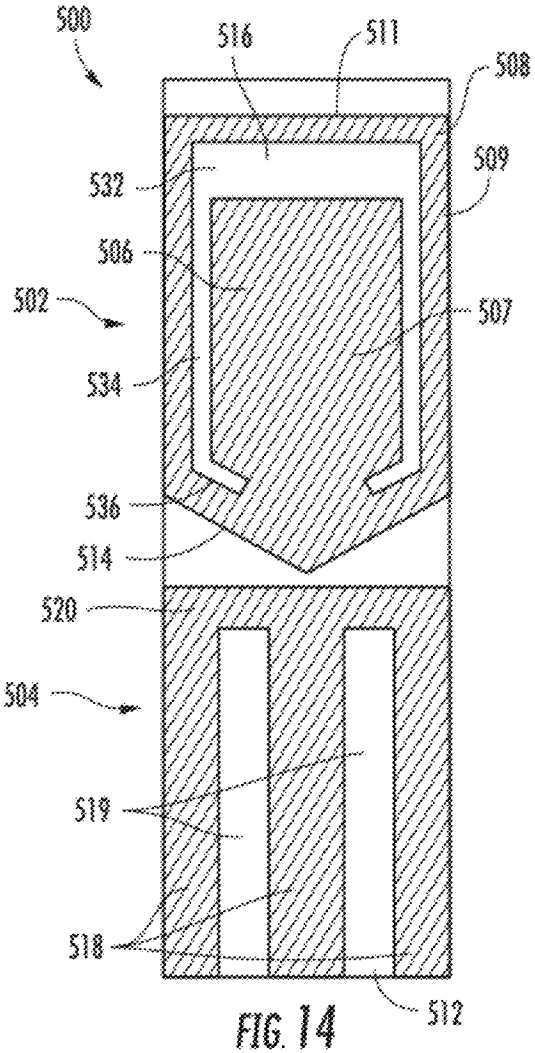
FIG. 14 is a plan view of another example embodiment of a omnidirectional multi-band antenna including one or more aspects of the present disclosure.

FIGS. 14 and 15 illustrate two other exemplary embodiments of omnidirectional multi-band antennas 500 and 600, respectively, according to one or more aspects of the present disclosure. The lower portions or planar skirt elements 504, 604 and substrates 512, 612 may be generally similar to the lower portion 404 and substrate 412 of antenna 400 discussed above. Accordingly, the radiating and ground elements 518, 618, slots 519, 619, and connecting elements 520, 620 of the respective antennas 500, 600 may be similarly sized and shaped to the corresponding elements 418, slots 419, and connecting element 420 of antenna 400. In addition, a feed (e.g., a coaxial cable, etc.) may be connected (e.g., soldered, etc.) to the antennas 500, 600 in a similar manner as discussed above for the antenna 400. Alternative embodiments may include other feeding arrangements and/or differently configured lower portions and elements thereof.

As shown by a comparison of FIGS. 7, 14, and 15, there are differences in the shapes of the upper portions 502, 602 of the respective antennas 500, 600 as compared to each other and to the upper portion 402 of the antenna 400. For example, the antenna 500 includes a generally n-shaped slot feature 516 (e.g., one or more slots that cooperative define a shape similar to the English alphabetic lower case letter "n"). The antenna 600 includes a generally v-shaped slot feature 616 (e.g., one or more slots that cooperative define a shape similar to the English alphabetic letter "v").

With continued reference to FIG. 14, the antenna 500 may be configured such that the antenna 500 is operable essentially as or similar to a standard half wavelength dipole antenna at a first frequency range (e.g., the 2.45 gigahertz band from 2.4 gigahertz to 2.5 gigahertz, etc.) and operable essentially as or similar to a wavelength dipole antenna at a second frequency band (e.g., the 5 gigahertz band from 4.9 gigahertz to 5.875 gigahertz, etc.). At the first frequency range, the antenna 500 may be operable such that the radiating element 508 has an electrical length of about $\lambda/4$. In this example, the electrical length of the radiating element 506 at the first frequency range or low band is relatively small such that the radiating element 506 should not really be considered an effective radiating element at this first frequency range or low band. Accordingly, only radiating element 508 is essentially radiating at the low band. But at the second frequency range or high band, both radiating elements 506, 508 are effective radiation with the radiating element 508 having an electrical wavelength of about $\lambda/2$ and the radiating element 506 having an electrical wavelength of about $\lambda/4$.

The antenna's upper portion 502 includes a tapering feature 514 for impedance matching. The illustrated tapering feature 514 is generally V-shaped (e.g., having a shape similar to the English alphabetic letter "v"). As shown in FIG. 15, the tapering feature 514 comprises the lower edge of the radiating elements of the antenna's upper portion 502 that is spaced apart from the lower portion 504 and oriented such that it is pointing generally at the middle of the connecting element 520 of the antenna's lower portion 504.

Slots 516 are introduced to the upper radiating elements 506, 508, which help enable multi-band operation of the antenna 500. The slots 516 cooperative define a shape similar to the English alphabetic lower case letter "n", such that the slots 516 include a generally rectangular top portion 532, two downwardly extending straight portions 534, and inwardly angled end portions 536.

By way of example, the upper radiating elements 506, 508 and slots 516 may be configured such that the upper radiating elements 508, 506 are operable as low and high band elements, respectively. As shown in FIG. 15, the "high band" radiating element 506 includes a generally rectangular shaped portion 507 connected to the tapering feature 514. The "low" band radiating element 508 includes two straight portions 509 separated and spaced apart from the rectangular portion 507 of the "high band" radiating element 506 by the slot portions 534. The straight portions 509 are connected to the tapering feature 514 and extend away from the tapering feature 514 in a direction opposite the lower portion 504 (upwardly in FIG. 14). Each straight portion 509 extends alongside and past the general rectangular portion 507 of the "high band" radiating element 506. The "low" band radiating element 508 also includes a connecting portion 511 perpendicular to and connecting the straight portions 509. The connecting portion 511 is separated and spaced apart from the rectangular portion 507 of the "high band" radiating element 506 by the slot portion 532.

In the particular embodiment shown in FIG. 14, the slots 516 may be carefully tuned so that the antenna 500 operates at high band (e.g., the 5 gigahertz band from 4.9 gigahertz to 5.875 gigahertz, etc.) with the upper and lower arms or portions 502, 504 each having an electrical length of about $\lambda/2$. But at low band (e.g., the 2.45 gigahertz band from 2.4 gigahertz to 2.5 gigahertz, etc.), the upper and lower arms or portions 502, 504 each have an electrical length of about $\lambda/4$. Alternative embodiments may include radiating elements, tapering features, and/or slots configured differently than that shown in FIG. 14, such as for producing different radiation patterns at different frequencies and/or for tuning to different operating bands.

With reference now to FIG. 15, the antenna 600 may be configured such that the antenna 600 is operable essentially as or similar to a standard half wavelength dipole antenna at a first frequency range (e.g., the 2.45 gigahertz band from 2.4 gigahertz to 2.5 gigahertz, etc.) and operable essentially as or similar to a wavelength dipole antenna at a second frequency band (e.g., the 5 gigahertz band from 4.9 gigahertz to 5.875 gigahertz, etc.). At the first frequency range, the antenna 600 may be operable such that the radiating element 608 has an electrical length of about $\lambda/4$. In this example, the electrical length of the radiating element 606 at the first frequency range or low band is relatively small such that the radiating element 606 should not really be considered an effective radiating element at this first frequency range or low band. Accordingly, only radiating element 608 is essentially radiating at the low band. But at the second frequency range or high band, both radiating elements 606, 608 are effective radiation with the radiating element 608 having an electrical wavelength of about $\lambda/2$ and the radiating element 606 having an electrical wavelength of about $\lambda/4$.

Figure 16:
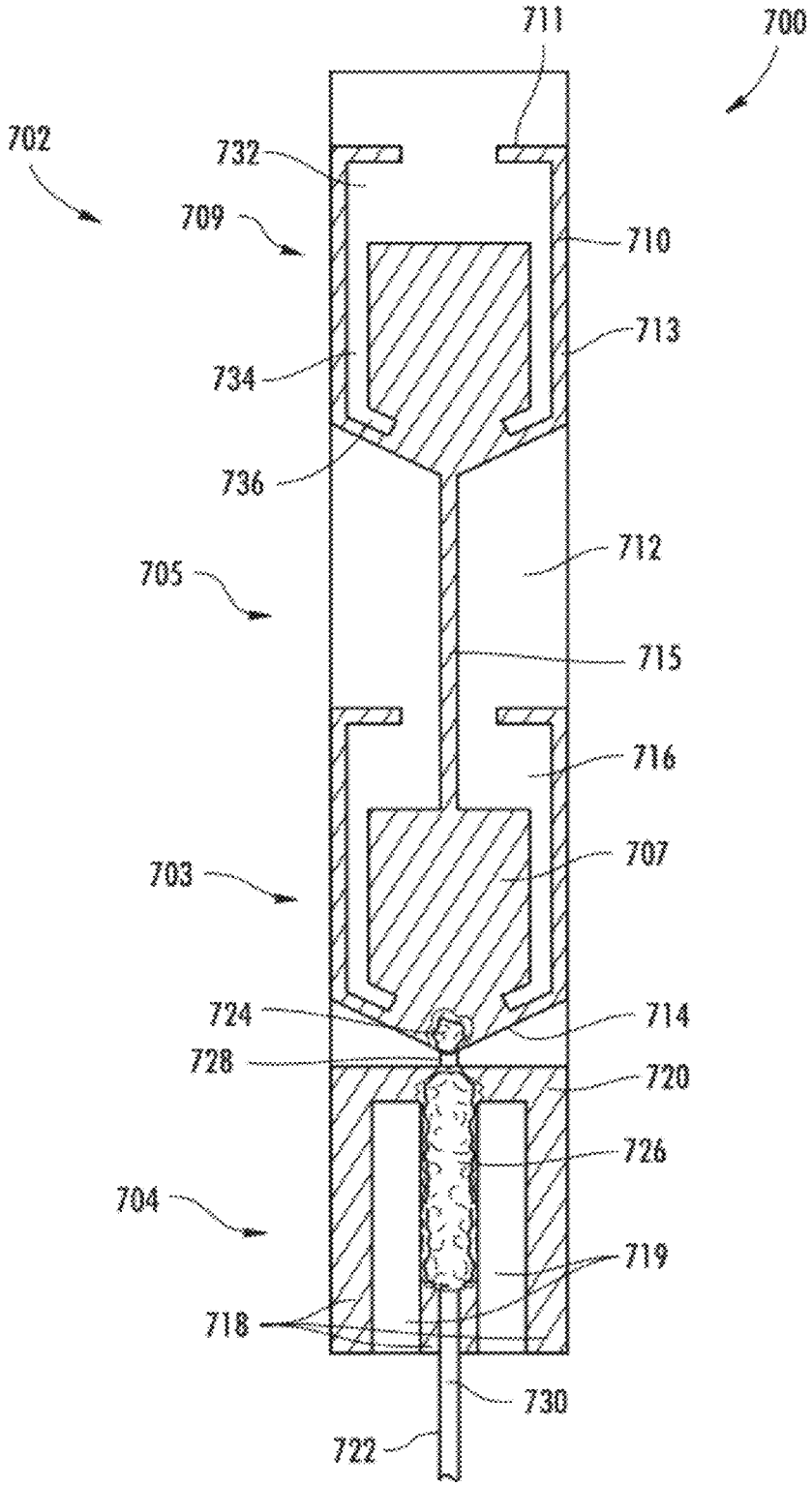
FIG. 16 illustrates another example embodiment of an omnidirectional multi-band antenna including one or more aspects of the present disclosure, in which a coaxial cable is coupled to the antenna.

The antenna's upper portion 602 includes a tapering feature 614 for impedance matching. The illustrated tapering feature 614 is generally v-shaped (e.g., having a shape similar to the English alphabetic letter "v"). As shown in FIG. 16, the tapering feature 614 comprises the lower edge of the radiating elements of the antenna's upper portion 602 that is spaced apart from the lower portion 604 and oriented such that it is pointing generally at the middle of the connecting element 620 of the antenna's lower portion 604.

Slots 616 are introduced to the upper radiating elements 606, 608, which help enable multi-band operation of the antenna 600. The slots 616 cooperative define a shape similar to the English alphabetic letter "v", such that the slots 616 include a lower generally triangular portion 632 and two upwardly extending straight portions 634.

By way of example, the upper radiating elements 606, 608 and slots 616 may be configured such that the upper radiating elements 608, 606 are operable as low and high band elements (e.g., 2.45 gigahertz band and 5 gigahertz band, etc.), respectively. As shown in FIG. 15, the "high band" radiating element 606 includes a generally rectangular shaped portion 607 connected to the tapering feature 614. The "low" band radiating element 608 includes two straight portions 609 separated and spaced apart from the rectangular portion 607 of the "high band" radiating element 606 by the slots 616. The straight portions 609 are connected to the tapering feature 614 and extend away from the tapering feature 614 in a direction opposite the lower portion 604 (upwardly in FIG. 15). Each straight portion 609 extends alongside and past the general rectangular portion 607 of the "high band" radiating element 606. The "low" band radiating element 608 also includes a connecting portion 611 perpendicular to and connecting the straight portions 609.

In the particular embodiment shown in FIG. 15, the slots 616 may be carefully tuned so that the antenna 600 operates at high band (e.g., the 5 gigahertz band from 4.9 gigahertz to 5.875 gigahertz, etc.) with the upper and lower arms or portions 602, 604 each having an electrical length of about $\lambda/2$. But at low band (e.g., the 2.45 gigahertz band from 2.4 gigahertz to 2.5 gigahertz, etc.), the upper and lower arms or portions 602, 604 each have an electrical length of about $\lambda/4$. Alternative embodiments may include radiating elements, tapering features, and/or slots configured differently than that shown in FIG. 15, such as for producing different radiation patterns at different frequencies and/or for tuning to different operating bands.

FIG. 16 illustrates another example embodiment of an omnidirectional multi-band antenna 700 including one or more aspects of the present disclosure. The antenna 700 includes upper and lower portions 702, 704 configured such that the antenna 700 may be operable as or similar to a wavelength dipole antenna at a first frequency range or low band (e.g., the 2.45 gigahertz band from 2.4 gigahertz to 2.5 gigahertz, etc.) and an array antenna at a second frequency range or high band (e.g., the 5 gigahertz band from 4.9 gigahertz to 5.875 gigahertz, etc.).

In this particular embodiment, the upper portion 702 includes three segments or parts 703, 705, 709. The antenna's lower portion or planar skirt element 704 and substrate 712 may be generally similar to the lower portion 404 and substrate 412 of antenna 400 discussed above. For example, the radiating and ground elements 718, slots 719, and connecting element 720 of the antenna 700 may be similarly sized and shaped to the corresponding elements 418, slots 419, and connecting element 420 of antenna 400. In addition, a feed may be connected to the antenna 700 in a similar manner as discussed above for the antenna 400. For example, inner and outer conductors 728, 730 of a coaxial cable 722 (e.g., IPEX coaxial connector, etc.) may be soldered 724, 726 to feed points of the antenna 700. Alternative embodiments may include other feeding arrangements and/or differently configured lower portions and elements thereof.

Figure 17:
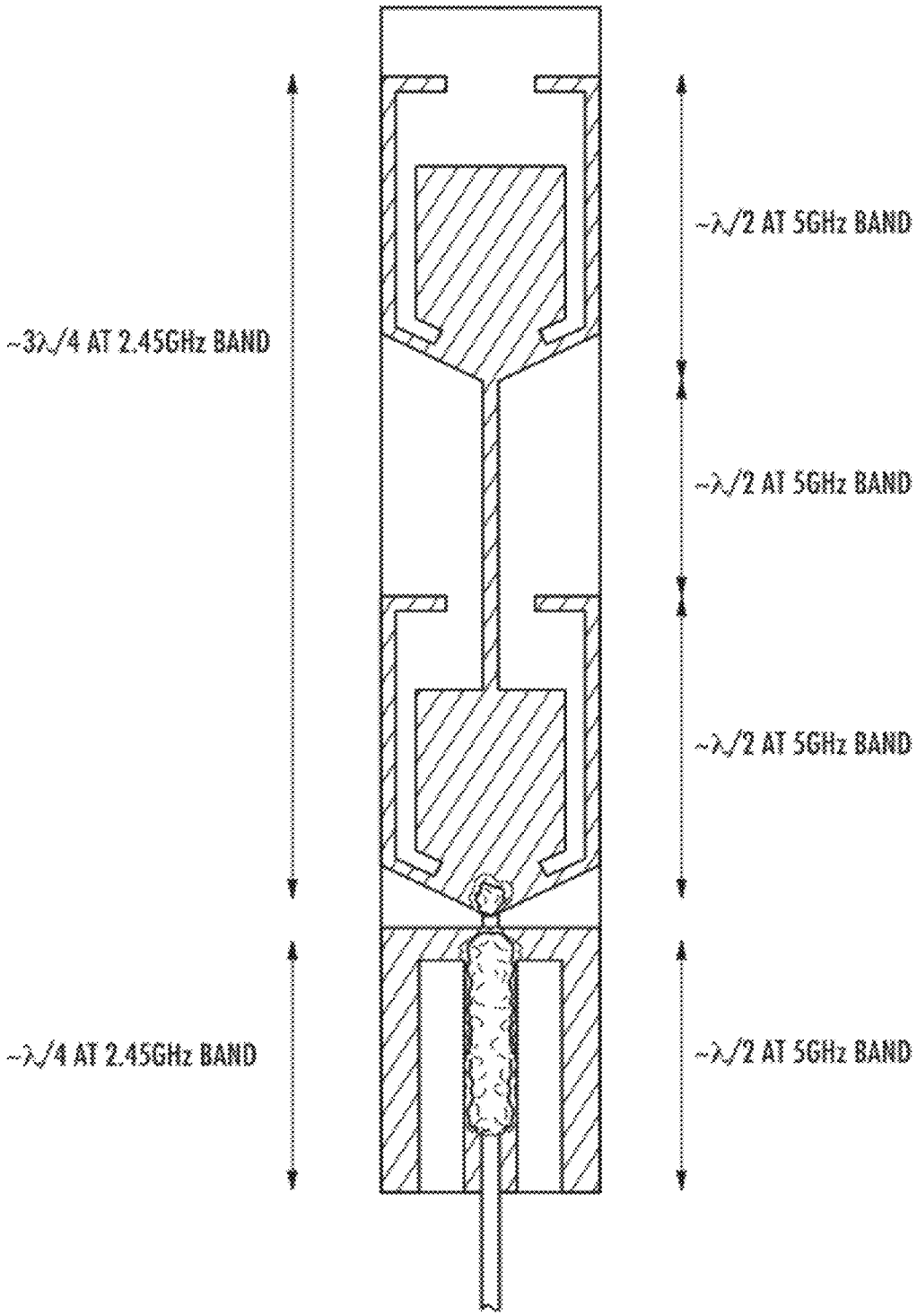
FIG. 17 illustrates the omnidirectional multi-band antenna shown in FIG. 16, and also illustrating the electrical lengths of the upper and lower portions of the antenna at the 2.45 gigahertz band and at the 5 gigahertz band where these electrical lengths are provided for purposes of illustration only according to exemplary embodiments.

As shown in FIG. 17, the antenna 700 may be configured to be operable at low band (e.g., the 2.45 gigahertz band from 2.4 gigahertz to 2.5 gigahertz, etc.) with the upper portion 702 having an electrical length of about three quarter wavelength (3λ/4) and the lower portion 704 having an electrical length of about one quarter wavelength (λ/4). At high band (e.g., the 5 gigahertz band from 4.9 gigahertz to 5.875 gigahertz, etc.), the antenna 70 may be operable with the lower portion 704 and each of three segments 703, 705, 709 of the upper portion 702 all having an electrical length of about one half wavelength (λ/2). Alternative embodiments may include radiating elements, tapering features, and/or slots configured differently than that shown in FIGS. 16 and 17, such as for producing different radiation patterns at different frequencies and/or for tuning to different operating bands.

With further reference to FIG. 16, each segment 703, 709 of the upper portion 702 includes a tapering feature 714 for impedance matching. The illustrated tapering feature 714 is generally V-shaped (e.g., having a shape similar to the English alphabetic letter "v").

Slots 716 are introduced to the radiating elements of the segments 703, 709 of the upper portion 702, which help enable multi-band operation of the antenna 700. The slots 716 include a top portion 732, two downwardly extending straight portions 734, and inwardly angled end portions 736. When the antenna 700 is operating, the slots 716 may help inhibit the antenna radiation pattern from squinting downward and/or also help make the radiation patterns tilt at horizontal.

Also shown in FIG. 16, each segment 703, 709 includes a generally rectangular shaped portion 707 connected to the corresponding tapering feature 714. Each segment 703, 709 also includes two L-shaped portions 710 (e.g., portions shaped like the English alphabetic capital letter "L") separated and spaced apart from the corresponding rectangular portion 707 by the slot portions 732, 734. Each L-shaped portion 710 includes a straight portion 713 and end portion 711 perpendicular to and extending inwardly from the straight portion 713. The straight portion 713 is connected to the tapering feature 714 and extends away from the tapering feature 714 in a direction opposite the lower portion 704 (upwardly in FIG. 16). Each straight portion 713 of the L-shaped portion 710 extends alongside and past the general rectangular portion 707. The end portion 711 of each L-shaped portion 710 extends inwardly from the corresponding straight portion 713 toward the end portion 711 of the other L-shaped portion 710. The end portions 711 are aligned with each other but are spaced-apart from each other and the generally rectangular portion 707 by slots 716. In addition, each end portion 711 extends inwardly from the corresponding straight portion 713 a sufficient distance such that each end portion 711 partially overlaps the width of the rectangular portion 707.

The middle segment 705 includes a generally straight portion 715 connected to the tapering feature 714 of the upper segment 709 and the generally rectangular portion 707 of the lower segment 703. This connection allows the antenna 700 to be operable as or similar to an array antenna at the 5 gigahertz band.

The antenna 700 may be configured such that the lower portion or planar skirt element 704 has an electrical length of about one quarter wavelength (λ/4) at low band (e.g., the 2.45 gigahertz band from 2.4 gigahertz to 2.5 gigahertz, etc.). When the outer conductor 730 of coaxial cable 722 is connected (e.g., soldered, etc.) to the planar skirt element 704, the planar skirt element 704 may behave as a quarter wavelength (λ/4) choke at low band. In which case, the antenna current (or at least a portion thereof) does not leak into the outer surface of the coaxial cable 722.

FIGS. 18 through 21 illustrate measured analysis results for the omnidirectional multi-band antenna 700 shown in FIG. 16. These measured analysis results shown in FIGS. 18 through 21 are provided only for purposes of illustration and not for purposes of limitation. Generally, these results show that the omnidirectional multi-band antenna 700 is operable essentially as or similar to a wavelength dipole at low band (e.g., the 2.45 gigahertz band from 2.4 gigahertz to 2.5 gigahertz, etc.) and a high gain array a high band (e.g., the 5 gigahertz band from 4.9 gigahertz to 5.875 gigahertz, etc.).

Figure 18:
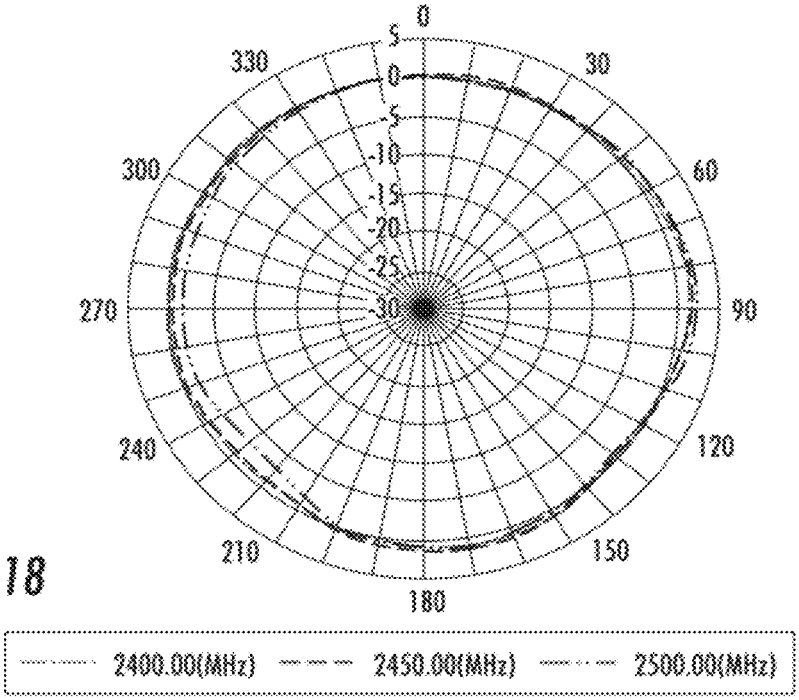
FIG. 18 illustrates measured azimuth radiation patterns (azimuth plane, theta 90 degree) for the example omnidirectional multi-band antenna shown in FIG. 16 for frequencies of 2400 megahertz, 2450 megahertz, and 2500 megahertz.
Figure 19:
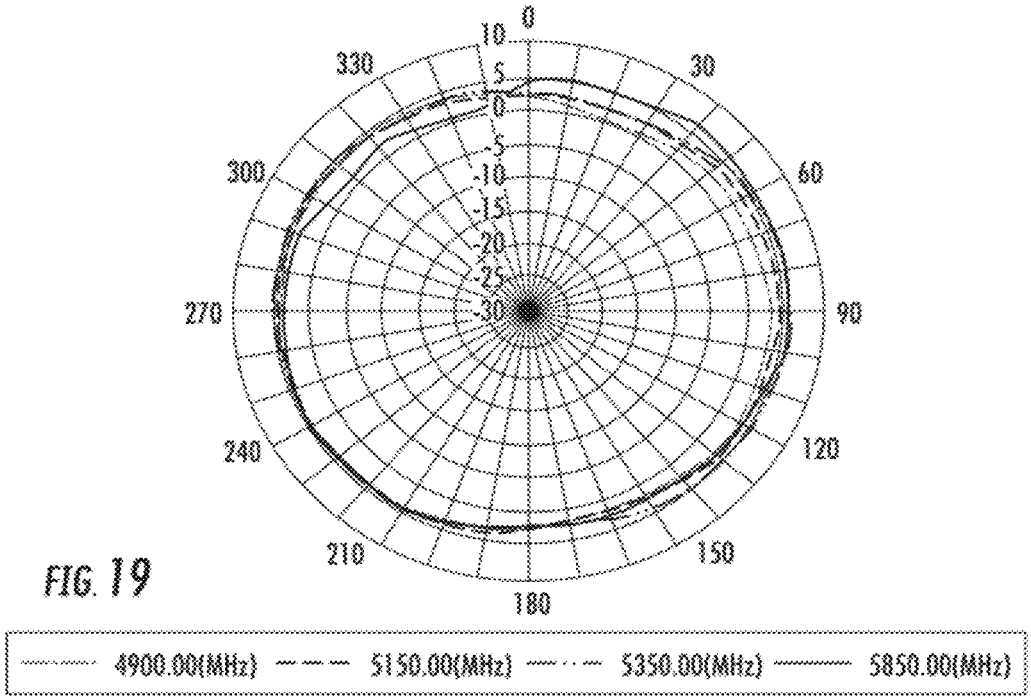
FIG. 19 illustrates measured azimuth radiation patterns (azimuth plane, theta 90 degree) for the example omnidirectional multi-band antenna shown in FIG. 16 for frequencies of 4900 megahertz, 5150 megahertz, 5350 megahertz, and 5850 megahertz.
Figure 20:
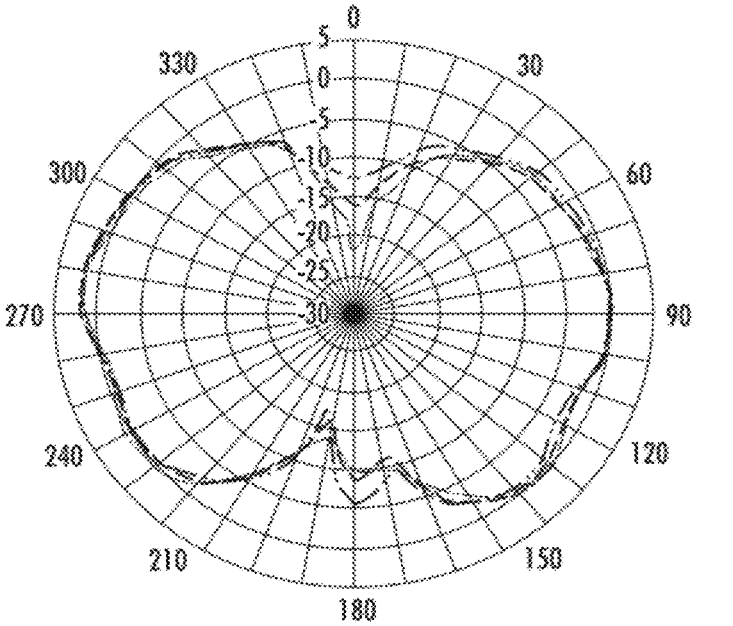
FIG. 20 illustrates measured zero degree elevation radiation patterns (phi zero degree plane) for the example omnidirectional multi-band antenna shown in FIG. 16 for frequencies of 2400 megahertz, 2450 megahertz, and 2500 megahertz.
Figure 21:
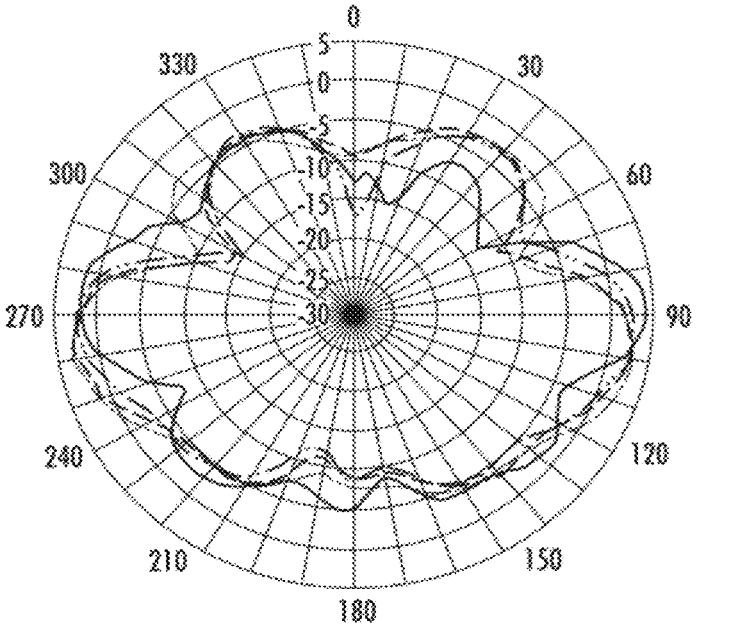
FIG. 21 illustrates measured zero degree elevation radiation patterns (phi zero degree plane) for the example omnidirectional multi-band antenna shown in FIG. 16 for frequencies of 4900 megahertz, 5150 megahertz, 5350 megahertz, and 5850 megahertz.
Figure 23:
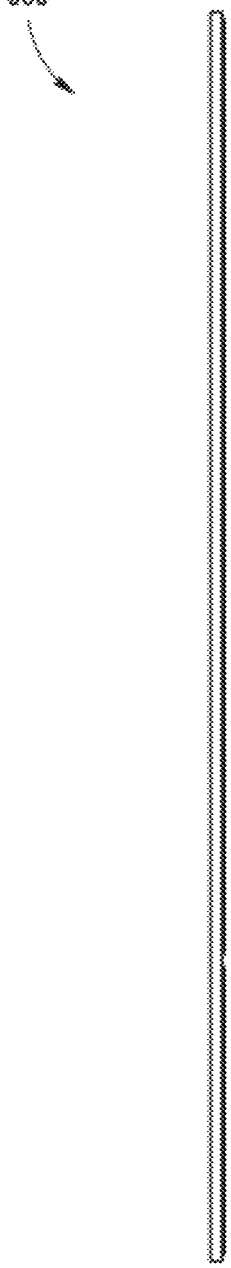
FIG. 23 is a side view of the example omnidirectional multi-band antenna shown in FIG. 22.

More specifically, FIG. 18 illustrates measured azimuth radiation patterns (azimuth plane, theta 90 degree) for the antenna 700 for frequencies of 2400 megahertz, 2450 megahertz, and 2500 megahertz. FIG. 19 illustrates measured azimuth radiation patterns (azimuth plane, theta 90 degree) for the antenna 700 for frequencies of 4900 megahertz, 5150 megahertz, 5350 megahertz, and 5850 megahertz. FIG. 20 illustrates measured zero degree elevation radiation patterns (phi zero degree plane) for the antenna 700 for frequencies of 2400 megahertz, 2450 megahertz, and 2500 megahertz. FIG. 21 illustrates measured zero degree elevation radiation patterns (phi zero degree plane) for the antenna 700 for frequencies of 4900 megahertz, 5150 megahertz, 5350 megahertz, and 5850 megahertz.

The table 2 below provides measured performance data relating to gain and efficiency for the omnidirectional multi-band antenna 700 shown in FIG. 16. As shown, the antenna 700 may be configured to achieve 3 dBi gain for the 2.45 gigahertz band and 4.5 dBi to 6 dBi for the 5 gigahertz band. This exemplary embodiment of the antenna 700 may achieve such results with a relatively small size and be manufacturable relatively easily as compared to the manufacture of back-to-back dipole antennas that utilize a double-sided printed circuit board.

TABLE 2

Summary of Results for Antenna 700

| Frequency (MHz) | 3D Efficiency | 3D Max Gain | Azimuth Max Gain | Azimuth Average Gain | Elevation 0 Max Gain | Elevation 0 Average Gain | Elevation 90 Max Gain | Elevation 90 Average Gain |
|---|---|---|---|---|---|---|---|---|
| 2400 | 75% | 2.64 | 1.55 | 0.10 | 1.81 | −4.60 | 1.81 | −4.60 |
| 2450 | 76% | 3.09 | 2.26 | 0.20 | 2.20 | −4.23 | 2.20 | −4.23 |
| 2500 | 72% | 3.10 | 2.23 | −0.29 | 2.13 | −3.81 | 2.13 | −3.81 |
| 4900 | 76% | 4.58 | 4.17 | 2.70 | 3.16 | −4.12 | 3.16 | −4.12 |
| 5150 | 77% | 5.44 | 4.41 | 3.24 | 2.91 | −4.92 | 2.91 | −4.92 |
| 5350 | 83% | 5.63 | 5.36 | 3.89 | 2.66 | −5.27 | 2.66 | −5.27 |
| 5450 | 82% | 5.43 | 5.25 | 3.85 | 2.61 | −5.52 | 2.61 | −5.52 |
| 5550 | 84% | 5.62 | 5.41 | 3.85 | 3.01 | −5.60 | 3.01 | −5.60 |
| 5850 | 84% | 6.01 | 5.81 | 3.34 | 3.92 | −5.04 | 3.92 | −5.04 |

FIG. 22 illustrates another exemplary embodiment of an omnidirectional multi-band antenna 800 according to one or more aspects of the present disclosure. The antenna 800 includes upper and lower portions 802, 804 configured such that the antenna 800 may be operable as or similar to a wavelength dipole antenna at a first frequency range or low band (e.g., the 2.45 gigahertz band from 2.4 gigahertz to 2.5 gigahertz, etc.) and an array antenna at a second frequency range or high band (e.g., the 5 gigahertz band from 4.9 gigahertz to 5.875 gigahertz, etc.).

In this particular embodiment of antenna 800, the upper portion 802 includes three segments or parts 803, 805, 809. The lower portion or planar skirt element 804 and substrate 812 may be generally similar to the lower portion 404, 704 and substrate 412, 712 of antennas 400 (FIG. 7), 700 (FIG. 16) discussed above. Accordingly, the radiating and ground elements 818, slots 819 and connecting elements 820 of the antenna 800 may be similarly sized and shaped to the corresponding elements 418, 718, slots 419, 719, and connecting element 420, 720 of respective antennas 400, 700.

In FIG. 22, the antenna 800 is shown without any feed connected thereto. Instead, FIG. 22 illustrates the antenna 800 with soldering pads 840 and 842. Accordingly, a feed (e.g., a coaxial cable, etc.) may be soldered to the antenna 800 in a similar manner as discussed above for the antennas 400 and 700. Alternative embodiments may include other feeding arrangements and/or differently configured lower portions and elements thereof.

The antenna 800 may be configured such that the lower portion or planar skirt element 804 has an electrical length of about one quarter wavelength ($\lambda/4$) at low band (e.g., the 2.45 gigahertz band from 2.4 gigahertz to 2.5 gigahertz, etc.). When the outer conductor of a coaxial cable is connected (e.g., soldered, etc.) to the planar skirt element 804, the planar skirt element 804 may behave as a quarter wavelength ($\lambda/4$) choke at low band. In which case, the antenna current (or at least a portion thereof) does not leak into the outer surface of the coaxial cable. This allows the antenna 800 to operate essentially like a wavelength ($\lambda$) dipole antenna for the 2.45 gigahertz band.

Figure 24:
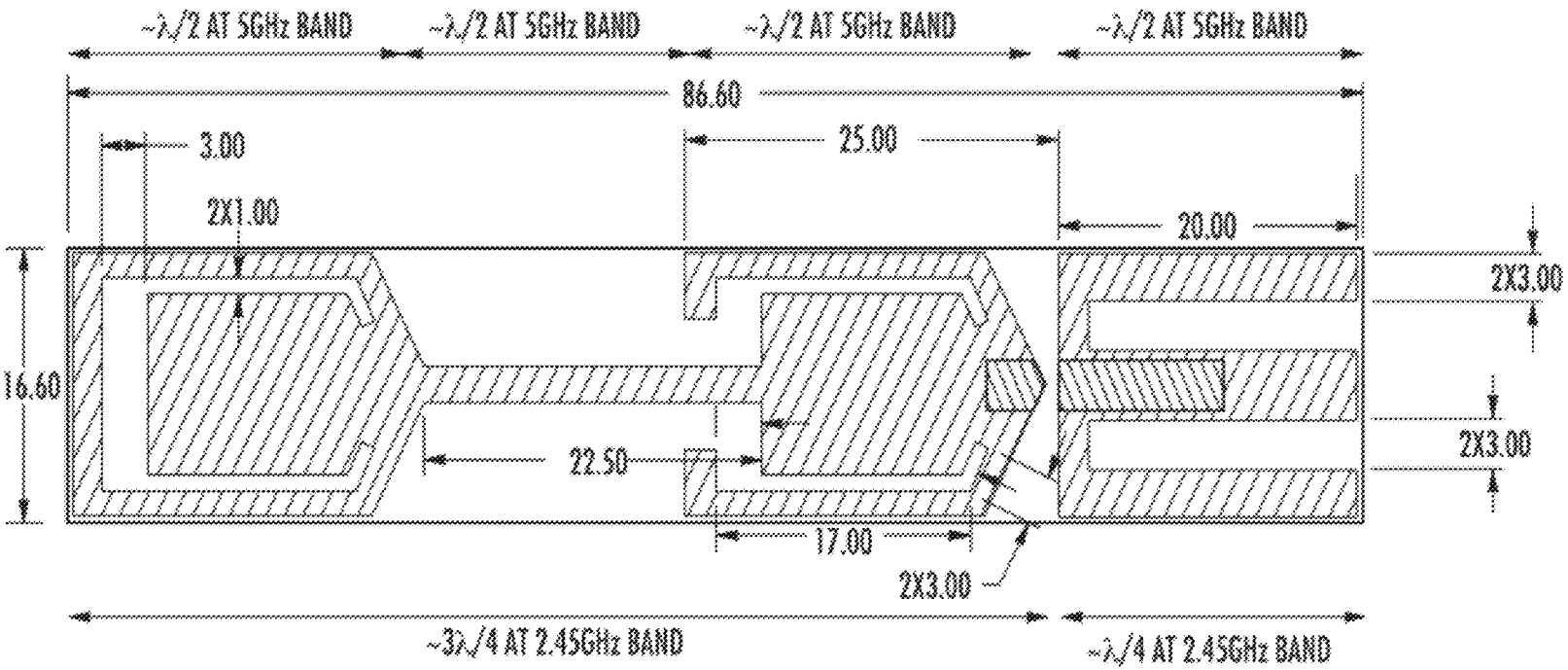
FIG. 24 is another plan view of the example omnidirectional multi-band antenna shown in FIG. 22 with exemplary dimensions provided for purposes of illustration only according to exemplary embodiments.

As shown in FIG. 24, the antenna 800 may be configured to be operable as or similar to a wavelength dipole antenna at the 2.45 gigahertz band with the upper portion 802 having an electrical length of about three quarter wavelength ($3\lambda/4$) and the lower portion 804 having an electrical length of about one quarter wavelength ($\lambda/4$). At the 5 gigahertz band, the lower portion 804 and each of three segments 803, 805, 809 of the upper portion 802 have an electrical length of about one half wavelength ($\lambda/2$). Alternative embodiments may include radiating elements, tapering features, and/or slots configured differently than that shown in FIGS. 22 and 24, such as for producing different radiation patterns at different frequencies and/or for tuning to different operating bands.

With further reference to FIG. 22, each segment 803, 809 of the upper portion 802 includes a tapering feature 814 for impedance matching. The illustrated tapering feature 814 is generally V-shaped (e.g., having a shape similar to the English alphabetic letter "v"). The tapering feature 814 comprises the lower edge of the radiating elements of the corresponding segment 803, 809 that is oriented such that it is pointing generally downwardly.

Slots 816 are introduced to the radiating elements of the segments 803, 809 of the upper portion 802, which help enable multi-band operation of the antenna 800. The segment 803 includes a generally n-shaped slot feature (e.g., one or more slots that cooperative define a shape similar to the English alphabetic lower case letter "n"). The slots 816 associated with each segment 803, 809 include top portions 832, two downwardly extending straight portions 834, and inwardly angled end portions 836. When the antenna 800 is operating, the slots 816 may help inhibit the antenna radiation pattern from squinting downward and/or may help make the radiation patterns tilt at horizontal.

Also shown in FIG. 22, the segment 803 includes a generally rectangular shaped portion 807 connected to the tapering feature 814 of the segment 803. The segment 803 also includes two L-shaped portions 810 (e.g., portions shaped like the English alphabetic capital letter "L") separated and spaced apart from the corresponding rectangular portion 807 by the slots. Each L-shaped portion 810 includes a straight portion 813 and end portion 811 perpendicular to and extending inwardly from the straight portion 813. The straight portion 813 is connected to the tapering feature 814 and extends away from the tapering feature 814 in a direction opposite the lower portion 804 (upwardly in FIG. 22). Each straight portion 813 of the L-shaped portion 810 extends alongside and past the general rectangular portion 807. The end portion 811 of each L-shaped portion 810 extends inwardly from the corresponding straight portion 813 toward the end portion 811 of the other L-shaped portion 810. The end portions 811 are aligned with each other but are spaced-apart from each other and the generally rectangular portion 807 by slots 816. In addition, each end portion 811 extends inwardly from the corresponding straight portion 813 a sufficient distance such that each end portion 811 partially overlaps the width of the rectangular portion 807.

The segment 809 includes a generally rectangular shaped portion 807 connected to the tapering feature 814 of the segment 809. The segment 809 further includes two straight portions 809 separated and spaced apart from the rectangular portion 807 by slots. The straight portions 809 are connected to and extend away from the tapering feature 814 in a direction opposite the lower portion 804 (upwardly in FIG. 22). Each straight portion 809 extends alongside and past the general rectangular portion 807. The segment 809 also includes a connecting portion 811 perpendicular to and connecting the straight portions 809. The connecting portion 811 is separated and spaced apart from the rectangular portion 807 by the slot portion 532.

The middle segment 805 includes a generally straight portion 815 connected to the tapering feature 814 of the upper segment 809 and the generally rectangular portion 807 of the lower segment 803. This connection allows the antenna 800 to be operable as or similar to an array antenna at high band (e.g., the 5 gigahertz band from 4.9 gigahertz to 5.875 gigahertz, etc.).

By way of example, FIG. 24 illustrates exemplary dimensions in millimeters for the antenna 800 according to an exemplary embodiment, where these dimensions are provided for purposes of illustration only and not for purposes of limitation. Alternative embodiments may include an antenna sized differently than what is shown in FIG. 24.

FIGS. 25 through 31 illustrate computer-simulated analysis results for the omnidirectional multi-band antenna 800 shown in FIG. 22. These computer-simulated analysis results shown in FIGS. 25 through 31 are provided only for purposes of illustration and not for purposes of limitation. Generally, these analysis results show that the omnidirectional multi-band antenna 800 is operable essentially as or similar to a wavelength dipole at low band (e.g., the 2.45 gigahertz band from 2.4 gigahertz to 2.5 gigahertz, etc.) and an array antenna at high band (e.g., the 5 gigahertz band from 4.9 gigahertz to 5.875 gigahertz, etc.).

Figure 25:
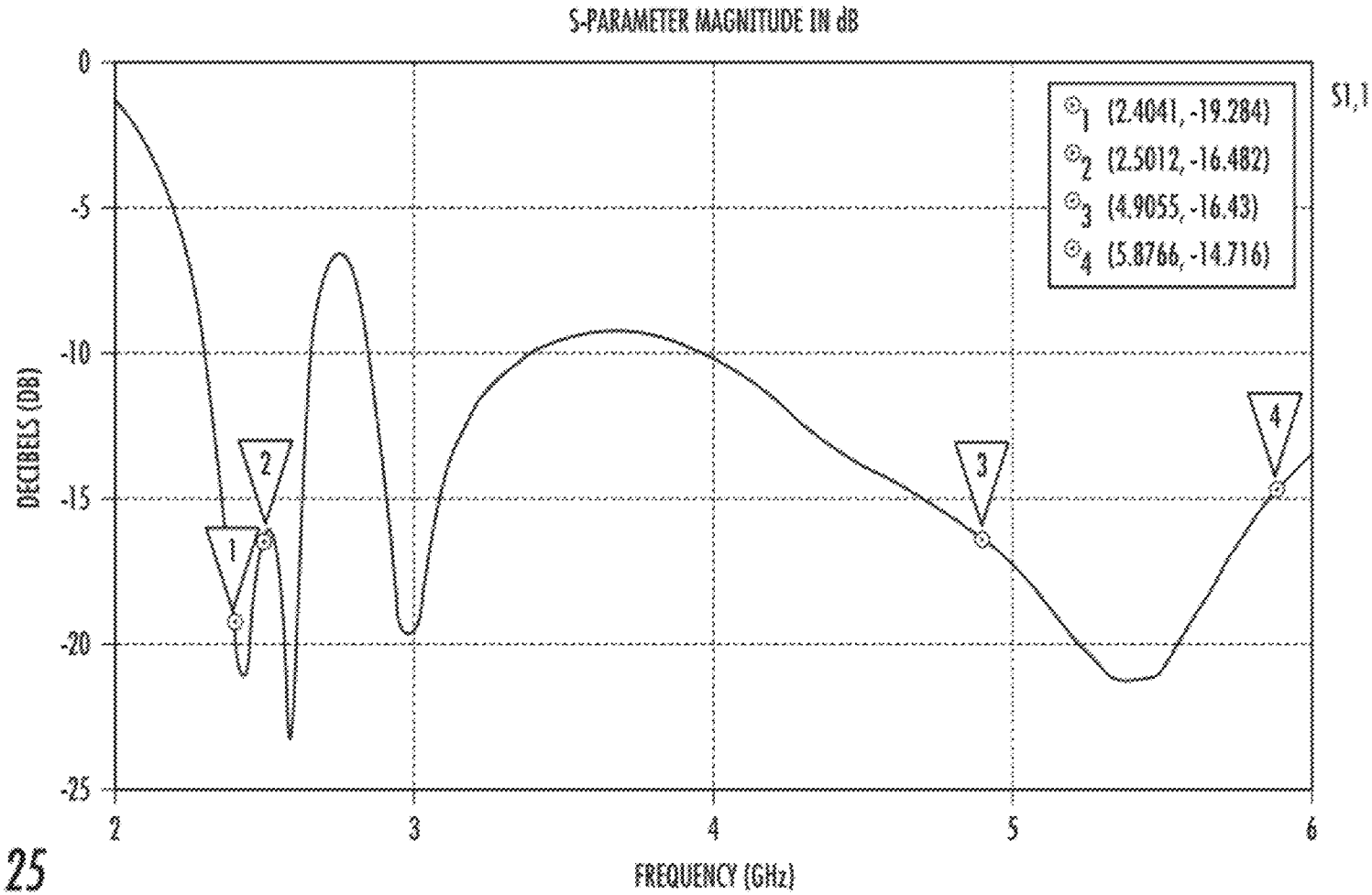
FIG. 25 is a line graph illustrating computer-simulated S1,1 parameter/return loss in decibels for the example omnidirectional multi-band antenna shown in FIG. 22 over a frequency range of 2 gigahertz to 6 gigahertz.

More specifically, FIG. 25 is a line graph illustrating computer-simulated S1,1 parameter/return loss in decibels for the antenna 800 over a frequency range of 2 gigahertz to 6 gigahertz. FIG. 26 illustrates computer-simulated far field realized gain in decibels for the antenna 800 at a frequency of 2.45 gigahertz, where the total efficiency was −0.2961 decibels and realized gain was 2.258 decibels, thereby indicating that the omnidirectional multi-band antenna shown in FIG. 22 is essentially operable as or similar to a wavelength dipole antenna at the frequency of 2.45 gigahertz but with a half wavelength radiation pattern. FIG. 27 illustrates computer-simulated azimuth radiation patterns (azimuth plane, theta 90 degree) for the antenna 800 for a frequency of 2.45 gigahertz. FIG. 28 illustrates computer-simulated zero degree elevation radiation patterns (phi zero degree plane) for the antenna 800 for a frequency of 2.45 gigahertz. FIG. 29 illustrates computer-simulated far field realized gain in decibels for the antenna 800 at a frequency of 5.5 gigahertz, where the total efficiency was −0.1980 decibels and realized gain was 5.441 decibels, thereby indicating that the omnidirectional multi-band antenna shown in FIG. 22 is essentially operable as or similar to a collinear dipole antenna array having high gain properties at the frequency of 5.5 gigahertz, FIG. 30 illustrates computer-simulated azimuth radiation patterns (azimuth plane, theta 90 degree) for the antenna 800 for a frequency of 5.5 gigahertz. FIG. 31 illustrates computer-simulated zero degree elevation radiation patterns (phi zero degree plane) for the antenna 800 for a frequency of 5.5 gigahertz.

FIGS. 32 through 34 illustrate several other exemplary embodiments of omnidirectional multi-band antennas 900, 1000, 1100 according to one or more aspects of the present disclosure. Each antenna 900, 1000, 1100 is configured for operation similar to the antennas 400 (FIG. 6), 500 (FIG. 14), 600 (FIG. 15), but each antenna 900, 1000, 1100 has some differences in the shapes of their radiating elements and/or the slots. For example, each antenna 1000 (FIGS. 33) and 1100 (FIG. 34) includes a lower portion or planar skirt element 1004, 1104 generally similar to the lower portion 404 of antenna 400 (FIG. 7). Each antenna 900, 1000, and 1100 includes tapering features 914, 1014, 1114. But the antennas 900, 1000, 1100 have upper portions 902, 1002, 1102 with radiating elements 906, 908, 1006, 1008, 1106, 1108 and slots 916, 1016, 1116 configured differently (e.g., sized, shaped, located, etc.) than each other and configured differently from the radiating elements 406, 408, 416 of the antenna 400. In addition, the antenna 900 (FIG. 32) also includes a lower portion 904 configured differently than lower portion 404 of antenna 400 (FIG. 7).

For each of the antennas 900, 1000, 1100, the slots 916, 1016, 1116 may be carefully tuned so that the antennas 900, 1000, 1100 each operates at high band (e.g., the 5 gigahertz band from 4.9 gigahertz to 5.875 gigahertz, etc.) with the upper and lower arms or portions each having an electrical length of about λ/2. But at low band (e.g., the 2.45 gigahertz band from 2.4 gigahertz to 2.5 gigahertz, etc.), the upper and lower arms or portions each have an electrical length of about λ/4. Alternative embodiments may include radiating elements, tapering features, and/or slots configured differently than that shown in FIGS. 32, 33, and 34, such as for producing different radiation patterns at different frequencies and/or for tuning to different operating bands.

FIG. 35 illustrates another example embodiment of an omnidirectional multi-band antenna assembly 1200 including one or more aspects of the present disclosure. In this illustrated embodiment, the antenna 1200 may be configured as a dual band antenna for operation in similar high and low frequency bands as the antennas disclosed above, but the antenna 1200 may be smaller in size with lower gain. For example, an exemplary embodiment may include the antenna 1200 being configured to be operable with 5 dBi at the 2.45 gigahertz band and 7 dBi at the 5 gigahertz band but with a non-pure omnidirectional radiation pattern. By way of further example, the antenna 1200 may include a substrate 1212 with a length of 35 millimeters and a width of 11 millimeters. By way of comparison, the substrate shown in FIG. 24 has a length of about 45 millimeters and a width of about 16.6 millimeters. Accordingly, the antenna 1200 includes a tradeoff between gain and size in that the average gain is lower for the smaller antenna 1200 than the average gain for the larger antennas 400 and 700. The gain values and dimensions in this paragraph are provided for purposes of illustration only and not for purposes of limitation, as alternative embodiments of the antenna 1200 may be configured differently (e.g., larger, smaller, shaped differently, configured for operation at different frequency bands and/or with higher or lower gain, etc.).

The omnidirectional multi-band antenna 1200 includes upper and lower portions 1202, 1204 configured such that the antenna 1200 may be operable as or similar to a printed dipole antenna. In the particular example shown in FIG. 35, the antenna 1200 includes upper and lower portions 1202, 1204 configured such that the antenna 1200 is operable essentially as or similar to a standard half wavelength dipole antenna at a first frequency range or low band (e.g., the 2.45 gigahertz band from 2.4 gigahertz to 2.5 gigahertz, etc.) with the upper and lower portions 1202, 1204 each having an electrical length of about λ/4. But at a second frequency range or high band (e.g., the 5 gigahertz band from 4.9 gigahertz to 5.875 gigahertz, etc.), the antenna 1200 is operable essentially as or similar to a wavelength dipole antenna with the upper and lower portions 1202, 1204 each having an electrical length of about λ/2.

At the first frequency range, the antenna 1200 may be operable such that the radiating element 1208 has an electrical length of about λ/4. But the electrical length of the radiating element 1206 at the first frequency range may be relatively small such that the radiating element 1206 should not really be considered an effective radiating element at the first frequency range. Accordingly, only radiating element 1208 is essentially radiating at the first frequency range. At the second frequency range or high band, both radiating elements 1206, 1208 are effective radiators with the radiating element 1208 having an electrical wavelength of about λ/2 and the radiating element 1206 having an electrical wavelength of about λ/4.

At the first and second frequency ranges, the lower portion 1204 may be operable as ground, which permits the antenna 1200 to be ground independent. Thus, the antenna 1200 does not depend on a separate ground element or ground plane. At the first frequency range (e.g., the 2.45 gigahertz band from 2.4 gigahertz to 2.5 gigahertz, etc.), the lower portion or planar skirt element 1204 has an electrical length of about one quarter wavelength (λ/4). With the outer conductor 1230 of coaxial cable 122 connected (e.g., soldered, etc.) to the planar skirt element 1204, the planar skirt element 1204 may behave as a quarter wavelength (λ/4) choke at the first frequency range. In which case, the antenna current (or at least a portion thereof) does not leak into the outer surface of the coaxial cable 1222. This allows the antenna 1200 to operate essentially like a half wavelength dipole antenna (λ/2) at low band. At the second frequency range or high band (e.g., the 5 gigahertz band from 4.9 gigahertz to 5.875 gigahertz, etc.), the lower portion 1204 has an electrical length of about λ/2, such that the lower portion 1204 may be considered more like a radiating element than a sleeve choke. This allows the antenna 1200 to operate essentially like a wavelength dipole antenna (λ) at high band.

The antenna's upper portion 1202 includes a tapering feature 1214 for impedance matching. The illustrated tapering feature 1214 is generally V-shaped (e.g., having a shape similar to the English alphabetic letter "v"). As shown in FIG. 35, the tapering feature 1214 comprises the lower edge of the radiating elements of the antenna's upper portion 1202 that is spaced apart from the lower portion 1204 and oriented such that it is pointing generally at the middle of the connecting element 1220 of the antenna's lower portion 1204.

Slots 1216 are introduced to the upper radiating elements 1206, 1208, which help to enable multi-band operation of the antenna 1200. By way of example, the upper radiating elements 1206, 1208 and slots 1216 may be configured such that the upper radiating elements 1208, 1206 are operable as low and high band elements (e.g., 2.45 gigahertz band and 5 gigahertz, etc.), respectively. In the illustrated example, the slots 1216 include a generally rectangular top portion 1232 and two downwardly extending straight portions 1234 perpendicular to the top portion 1232.

As shown in FIG. 35, the "high band" radiating element 1206 includes a generally rectangular shaped portion 1207 connected to the tapering feature 1214 such that the rectangular portion 1207 and tapering feature 1214 cooperatively define an arrow shape. The "low" band radiating element 1208 includes two L-shaped portions 1210 (e.g., portions shaped like the English alphabetic capital letter "L") separated and spaced apart from the rectangular portion 1207 of the "high band" radiating element 1206 by the slot portions 1232, 1234. Each L-shaped portion 1210 includes a straight portion 1213 and an end portion 1211 perpendicular to and extending inwardly from the straight portion 1213. The straight portion 1213 is connected to the tapering feature 1214 and extends away from the tapering feature 1214 in a direction opposite the lower portion 1204 (upwardly in FIG. 35). Each straight portion 1213 of the L-shaped portion 1210 extends alongside and past the general rectangular portion 1207 of the "high band" radiating element 1206. The end portion 1211 of each L-shaped portion 1210 extends inwardly from the corresponding straight portion 1213 toward the end portion 1211 of the other L-shaped portion 1210. The end portions 1211 are aligned with each other but are spaced-apart from each other and the generally rectangular portion 1207 of the "high band" radiating element 1206 by slots 1216. In addition, each end portion 1211 extends inwardly from the corresponding straight portion 1213 a sufficient distance such that each end portion 1211 partially overlaps the width of the rectangular portion 1207 of the "high band" radiating element 1206.

In the particular embodiment shown in FIG. 35, the slots 1216 may be carefully tuned so that the antenna 1200 operates at high band (e.g., the 5 gigahertz band from 4.9 gigahertz to 5.875 gigahertz, etc.) with the upper and lower arms or portions 1202, 1204 each having an electrical length of about $\lambda/2$. But at low band (e.g., the 2.45 gigahertz band from 2.4 gigahertz to 2.5 gigahertz, etc.), the upper and lower arms or portions 1202, 1204 each have an electrical length of about $\lambda/4$. Alternative embodiments may include radiating elements, tapering features, and/or slots configured differently than that shown in FIG. 35, such as for producing different radiation patterns at different frequencies and/or for tuning to different operating bands.

The antenna 1200 may include feed locations or points (e.g., solder pads, etc.) for connection to a feed. In the illustrated example shown in FIG. 127, the feed is a coaxial cable 1222 (e.g., IPEX coaxial connector, etc.) soldered 1224, 1226 to the feed points of the antenna 1200. More specifically, an inner conductor 1228 of the coaxial cable 1222 is soldered 1224 to the feed location adjacent and/or on a portion of the tapering feature 1214 of the upper radiating portion 1202. The outer conductor 1230 of the coaxial cable 1222 is soldered 1226 to the connecting element 1220 and/or middle element 1218 of the skirt or lower portion 1204. The outer conductor 1230 may be soldered along a length of the middle element 1218 and/or directly to the substrate 1212, for example, to provide additional strength and/or reinforcement to the connection of the coaxial cable 1222. Alternative embodiments may include other feeding arrangements, such as other types of feeds besides coaxial cables and/or other types of connections besides soldering, such as snap connectors, press fit connections, etc.

FIGS. 36 through 43 illustrate analysis results measured for a prototype of the omnidirectional multi-band antenna 1200 shown in FIG. 35. These analysis results shown in FIGS. 36 through 43 are provided only for purposes of illustration and not for purposes of limitation. Generally, these analysis results show that the omnidirectional multi-band antenna 1200 is operable essentially as a dual band dipole in at least two frequency bands—a low band (e.g., the 2.45 gigahertz band from 2.4 gigahertz to 2.5 gigahertz, etc.) and a high band (e.g., the 5 gigahertz band from 4.9 gigahertz to 5.875 gigahertz, etc.). The analysis results also show that the antenna 1200 is capable of operating at both free space and load with plastic cover unlike some existing multi-band printed dipoles that may incur significant frequency changes when loaded with dielectric.

More specifically, FIG. 36 is a line graph illustrating return loss in decibels measured for a prototype of the antenna 1200 operating in free space over a frequency range of 1 gigahertz to 6 gigahertz. FIG. 37 is a line graph illustrating return loss in decibels measured for the prototype of the antenna 1200 operating at load with plastic cover over a frequency range of 1 gigahertz to 6 gigahertz. FIG. 38 illustrates azimuth radiation patterns (azimuth plane, theta 90 degree) measured for the prototype of the antenna 1200 for frequencies of 2400 megahertz, 2450 megahertz, and 2500 megahertz. FIG. 39 illustrates azimuth radiation patterns (azimuth plane, theta 90 degree) measured for the prototype of the antenna 1200 for frequencies of 4900 megahertz, 5150 megahertz, 5350 megahertz, 5470 megahertz, 5710 megahertz, 5780 megahertz, and 5850 megahertz. FIG. 40 illustrates zero degree elevation radiation patterns (phi zero degree plane) measured for the prototype of the antenna 1200 for frequencies of 2400 megahertz, 2450 megahertz, and 2500 megahertz. FIG. 41 illustrates zero degree elevation radiation patterns (phi zero degree plane) measured for the prototype of the antenna 1200 for frequencies of 4900 megahertz, 5150 megahertz, 5350 megahertz, 5470 megahertz, 5710 megahertz, 5780 megahertz, and 5850 megahertz. FIG. 42 illustrates elevation radiation patterns (phi 90 degree) measured for the prototype of the antenna 1200 for frequencies of 2400 megahertz, 2450 megahertz, and 2500 megahertz. FIG. 43 illustrates elevation radiation patterns (phi 90 degree) measured for the prototype of the antenna 1200 for frequencies of 4900 megahertz, 5150 megahertz, 5350 megahertz, 5470 megahertz, 5710 megahertz, 5780 megahertz, and 5850 megahertz.

The table 3 below provides performance data relating to gain and efficiency that was measured during testing of the prototype of the antenna 1200 shown in FIG. 35.

TABLE 3

Summary of Results for Antenna 1200

| Frequency (MHz) | 3D Efficiency | 3D Max Gain | Azimuth Max Gain | Azimuth Average Gain | Elevation 0 Max Gain | Elevation 0 Average Gain | Elevation 90 Max Gain | Elevation 90 Average Gain |
|---|---|---|---|---|---|---|---|---|
| 2400 | 74% | 4.69 | 0.78 | −3.88 | 4.05 | −2.94 | 4.05 | −2.94 |
| 2450 | 75% | 5.12 | 0.26 | −4.01 | 4.57 | −3.10 | 4.57 | −3.10 |

TABLE 3-continued

| Summary of Results for Antenna 1200 | | | | | | | | |
|---|---|---|---|---|---|---|---|---|
| | 3D | | | | | | | |
| Fre- | Effi- | | Azimuth | | Elevation 0 | | Elevation 90 | |
| quency (MHz) | cien-cy | Max Gain | Max Gain | Average Gain | Max Gain | Average Gain | Max Gain | Average Gain |
| 2500 | 75% | 4.83 | −0.35 | −4.24 | 4.56 | −3.49 | 4.56 | −3.49 |
| 4900 | 67% | 3.55 | 3.53 | −2.15 | −2.37 | −7.86 | −2.37 | −7.86 |
| 5150 | 70% | 4.58 | 4.57 | −1.73 | −1.55 | −7.15 | −1.55 | −7.15 |
| 5350 | 72% | 5.17 | 4.846 | −1.85 | 4.05 | −6.49 | −1.40 | −6.49 |
| 5470 | 73% | 5.68 | 5.47 | −2.41 | 0.50 | −5.94 | 0.50 | −5.94 |
| 5710 | 92% | 6.09 | 5.53 | −1.04 | 3.62 | −2.89 | 3.62 | −2.89 |
| 5780 | 97% | 7.02 | 6.47 | −0.96 | 4.83 | −2.65 | 4.83 | −2.65 |
| 5850 | 94% | 7.02 | 6.55 | −1.14 | 4.846 | −2.91 | 4.83 | −2.91 |

The various radiating elements disclosed herein may be made of electrically-conductive material, such as, for example, copper, silver, gold, alloys, combinations thereof, other electrically-conductive materials, etc. Further, the upper and lower elements may all be made out of the same material, or one or more may be made of a different material than the others. Still further, a "high band" radiating element may be made of a different material than the material from which a "low band" radiating element is formed. Similarly, the lower elements may each be made out of the same material, different material, or some combination thereof. The materials provided herein are for purposes of illustration only as an antenna may be configured from different materials and/or with different shapes, dimensions, etc. depending, for example, on the particular frequency ranges desired, presence or absence of a substrate, the dielectric constant of any substrate, space considerations, etc.

In the various exemplary embodiments of the antennas disclosed herein (e.g., antenna 400 (FIG. 7), antenna 500 (FIG. 14), antenna 600 (FIG. 15), antenna 700 (FIG. 16), antenna 800 (FIG. 22), antenna 900 (FIG. 32), antenna 1000 (FIG. 33), antenna 1100 (FIG. 34), antenna 1200 (FIG. 35)), radiating elements may all be supported on the same side of a substrate. Allowing all the radiating elements to be on the same side of the substrate eliminates the need for a double-sided printed circuit board. The radiating elements disclosed herein may be fabricated or provided in various ways and supported by different types of substrates and materials, such as a circuit board, a flexible circuit board, sheet metal, a plastic carrier, Flame Retardant 4 or FR4, flex-film, etc. Various exemplary embodiments include a substrate comprising a flex material or dielectric or electrically non-conductive printed circuit board material. In exemplary embodiments that include a substrate formed from a relatively flexible material, the antenna may be flexed or configured so as to follow the contour or shape of the antenna housing profile. The substrate may be formed from a material having low loss and dielectric properties. According to some embodiments, an antenna disclosed herein may be, or may be part of a, printed circuit board (whether rigid or flexible) where the radiating elements are all conductive traces (e.g., copper traces, etc.) on the circuit board substrate. In which case, the antenna thus may be a single sided PCB antenna. Alternatively, the antenna (whether mounted on a substrate or not) may be constructed from sheet metal by cutting, stamping, etching, etc. In various exemplary embodiments, the substrate may be sized differently depending, for example, on the particular application as varying the thickness and dielectric constant of the substrate may be used to tune the frequencies. By way of example, a substrate may have a length of about 86.6 millimeters, a width of about 16.6 millimeters, and a thickness of about 0.80 millimeters. Alternative embodiments may include a substrate with a different configuration (e.g., different shape, size, material, etc.). The materials and dimensions provided herein are for purposes of illustration only as an antenna may be made from different materials and/or configured with different shapes, dimensions, etc. depending, for example, on the particular frequency ranges desired, presence or absence of a substrate, the dielectric constant of any substrate, space considerations, etc.

As is evident by the various configurations of the illustrated embodiments of antenna 400 (FIG. 7), antenna 500 (FIG. 14), antenna 600 (FIG. 15), antenna 700 (FIG. 16), antenna 800 (FIG. 22), antenna 900 (FIG. 32), antenna 1000 (FIG. 33), antenna 1100 (FIG. 34), antenna 1200 (FIG. 35), antennas according to the present disclosure may be varied without departing from the scope of this disclosure and the specific configurations disclosed herein are exemplary embodiments only and are not intended to limit this disclosure. For example, as shown by a comparison of FIGS. 7, 14, 15, 16, 22, 32, 33, 34, and 35, the size, shape, length, width, inclusion, etc. of the radiating elements, elements of lower portion or planar skirt element, and/or slots may be varied. One or more of such changes may be made to adapt an antenna to different frequency ranges, to the different dielectric constants of any substrate (or the lack of any substrate), to increase the bandwidth of one or more resonant radiating elements, to enhance one or more other features, etc.

The various antennas (e.g., 400, 500, 600, 700, 800, 900, etc.) disclosed herein may be integrated in, embedded in, installed to, mounted on, etc. a wireless application device (not shown), including, for example, a personal computer, a cellular phone, personal digital assistant (PDA), etc. within the scope of the present disclosure. By way of example, an antenna disclosed herein may be mounted to a wireless application device (whether inside or outside the device housing) by means of double sided foam tape or screws. If mounted with screws, holes (not shown) may be drilled through the antenna (preferably through the substrate). The antenna may also be used as an external antenna. The antenna may be mounted in its own housing, and a coaxial cable may be terminated with a connector for connecting to an external antenna connector of a wireless application device. Such embodiments permit the antenna to be used with any suitable wireless application device without needing to be designed to fit inside the wireless application device housing.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms (e.g., different materials may be used, etc.) and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values (e.g., frequency ranges, etc.) for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items. The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An omnidirectional multi-band antenna comprising:

an upper portion including at least one segment having one or more upper radiating elements, one or more tapering features, and one or more slots;

a lower portion including one or more lower radiating elements and one or more slots;

whereby the one or more slots of the upper and lower portions enable multi-band operation of the antenna and the one or more tapering features are operable for impedance matching;

whereby the antenna is operable within a first frequency range, with the lower portion and the at least one segment of the upper portion each having an electrical length of about $\lambda/4$; and whereby the antenna is operable within a second frequency range, with the lower portion and the at least one segment of the upper portion each having an electrical length of about $\lambda/2$;

wherein:

the lower portion comprises two generally rectangular radiating elements and a generally rectangular ground element disposed between the two radiating elements, the two radiating elements spaced apart from the ground element by the one or more slots of the lower portion of the antenna, the two radiating elements and ground element generally perpendicular to and connected to a generally rectangular connecting radiating element; and the lower portion comprises a planar skirt element; and/or the lower portion is configured to be operable as a quarter wavelength ($\lambda/4$) choke at the first frequency range, such that at least a portion of the antenna current does not leak into an outer surface of a coaxial cable when the antenna is being fed by the coaxial cable; and/or the lower portion is configured to be operable as ground; and/or the lower portion is operable as a sleeve choke at the first frequency range.

2. The antenna of claim 1, wherein:

the first frequency range is the 2.45 gigahertz band from about 2.4 gigahertz to about 2.5 gigahertz, and the second frequency range is the 5 gigahertz band from about 4.9 gigahertz to about 5.875 gigahertz.

3. The antenna of claim 1, wherein:

the upper portion includes three segments each including one or more upper radiating elements;

the antenna is configured to be operable within the first frequency range, such that each of the three segments of the upper portion have an electrical length of about λ/4, thereby providing the upper portion with a combined electrical length of about 3λ/4; and the antenna is configured to be operable within the second frequency range, such that each of the three segments of the upper portion have an electrical length of about λ/2, thereby providing the upper portion with a combined electrical length of about 3λ/2.

4. The antenna of claim 1, wherein the upper portion comprises:

upper and lower segments each having one or more upper radiating elements, one or more tapering features, and one or more slots; and a middle generally straight segment between and connected to the upper and lower segments.

5. The antenna of claim 1, wherein:

the upper portion includes only one segment;

the antenna is configured to be operable within the first frequency range, such that the upper portion has an electrical length of about λ/4; and the antenna is configured to be operable within the second frequency, such that the upper portion has an electrical length of about λ/2.

6. The antenna of claim 1, wherein the one or more tapering features comprise at least one generally V-shaped edge of at least one radiating element of the at least one segment of the antenna's upper portion, and wherein the at least one generally V-shaped edge is spaced apart from the antenna's lower portion and oriented so as to point generally toward the antenna's lower portion.

7. The antenna of claim 1, wherein the one or more slots of the at least one segment of the antenna's upper portion include a generally rectangular or triangular portion and two generally straight portions connected to and extending from the generally rectangular or triangular portion.

8. The antenna of claim 7, wherein:

the one or more slots of the at least one segment of the antenna's upper portion further comprise inwardly angled end portions connected to the straight portions; and/or the one or more slots of the at least one segment of the antenna's upper portion include the generally rectangular portion adjacent an upper end of the at least one segment; and/or the one or more slots of the at least one segment of the antenna's upper portion include the generally triangular portion adjacent the one or more tapering features of the at least one segment.

9. The antenna of claim 1, wherein:

the upper radiating elements comprise high and low band radiating elements with one or more slots therebetween; and the antenna is configured such that:

at the first frequency range, the low band radiating element has an electrical length of about λ/4; and at the second frequency range, the high and low band radiating elements respectively have electrical lengths of about λ/4and λ/2.

10. The antenna of claim 9, wherein:

the high band radiating element includes a generally rectangular shaped portion connected to the one or more tapering features; and the low band radiating element includes two generally straight portions connected to the one or more tapering features and extending alongside the generally rectangular portion of the high band radiating element.

11. The antenna of claim 10, wherein:

the generally rectangular shaped portion and the one or more tapering features cooperatively define an arrow shape; and/or the low band radiating element further comprises:

a connecting element connecting the end portions of the generally straight portions; or two end portions generally perpendicular to and extending inwardly from a corresponding one of the generally straight portions and/or two generally L-shaped portions.

12. The antenna of claim 1, wherein the one or more slots of the at least one segment of the antenna's upper portion generally define a shape substantially resembling the English alphabetic letter "v" or "n".

13. The antenna of claim 1, wherein:

the antenna is operable with at least about 2 decibels referenced to isotropic gain (dBi) for the 2.45 gigahertz band and with more than 4 dBi for the 5 gigahertz band; and/or the antenna is configured such that:

the antenna operates essentially as a standard half wavelength dipole antenna at the 2.45 gigahertz band and a wavelength dipole antenna at the 5 gigahertz band; or the antenna operates essentially as a wavelength dipole antenna at the 2.45 gigahertz band and a collinear array antenna at the 5 gigahertz band.

14. The antenna of claim 1, wherein:

the radiating elements, the one or more tapering features, and the one or more slots are on the same side of a printed circuit board; and/or the antenna further comprises a substrate supporting the upper and lower portions of the antenna on a same side of the substrate.

15. The antenna of claim 1, further comprising:

a coaxial cable having inner and outer conductors electrically coupled to the respective upper and lower portions of the antenna; and/or a circuit board supporting the upper and lower portions of the antenna on a same side of the circuit board, and wherein the upper and lower radiating elements comprise conductive traces on the circuit board.

16. An omnidirectional multi-band antenna comprising:

an upper portion including: an upper segment having one or more upper radiating elements, one or more tapering features, and one or more slots;

a lower segment having one or more upper radiating elements, one or more tapering features, and one or more slots;

a middle generally straight radiating segment connected to the upper and lower segments;

a lower portion including one or more lower radiating elements and one or more slots;

wherein:

the lower portion comprises two generally rectangular radiating elements and a generally rectangular ground element disposed between the two radiating elements, the two radiating elements spaced apart from the .ground element by the one or more slots of the lower portion of the antenna, the two radiating elements and ground element generally perpendicular to and connected to a generally rectangular connecting radiating element; and the lower portion is configured to be operable as a quarter wavelength (λ/4) choke at the first frequency range, such that at least a portion of the antenna current does not leak into an outer surface of a coaxial cable when the antenna is being fed by the coaxial cable; and/or the lower portion is operable as a sleeve choke at the first frequency range; and/or the lower portion is configured to be operable as ground.

17. The antenna of claim 16, wherein:

the antenna is configured to be operable within a first frequency range, such that the lower portion has an electrical length of about λ/4 and such that each of the three segments of the upper portion have an electrical length of about λ/4, thereby providing the upper portion with a combined electrical length of about 3λ/4; and the antenna is configured to be operable within a second frequency range, such that the lower portion has an electrical length of about λ/2 and such that each of the three segments of the upper portion have an electrical length of about λ/2, thereby providing the upper portion with a combined electrical length of about 3λ/2.

18. The antenna of claim 17, wherein:

the first frequency range is the 2.45 gigahertz band from about 2.4 gigahertz to about 2.5 gigahertz; and the second frequency range is the 5 gigahertz band from 4.9 gigahertz to 5.875 gigahertz.

19. The antenna of claim 16, wherein the one or more tapering features comprises at least one generally V-shaped edge of at least one radiating element of the corresponding upper and lower segments that is spaced apart from the antenna's lower portion and oriented so as to point generally toward the antenna's lower portion.

20. The antenna of claim 16, wherein the one or more slots of each of the upper and lower segments includes a generally rectangular portion, two generally straight portions connected to and extending from the generally rectangular portion generally towards the antenna's lower portion, and inwardly angled end portions connected to the straight portions.

21. The antenna of claim 16, wherein:

the upper segment includes a generally rectangular shaped portion connected to the one or more tapering features of the upper segment, two generally straight portions connected to the one or more tapering features, and a connecting element connecting the end portions of the generally straight portions; and the lower segment includes a generally rectangular shaped portion connected to the one or more tapering features of the lower segment, and two generally L-shaped straight portions connected to the one or more tapering features and extending alongside the generally rectangular portion.

22. The antenna of claim 16, wherein:

the radiating elements, the one or more tapering features, and the one or more slots are on the same side of a printed circuit board; and/or the antenna further comprises a substrate supporting the upper and lower portions of the antenna on a same side of the substrate; and/or the antenna further comprises a circuit board supporting the upper and lower portions of the antenna on a same side of the circuit board, and wherein the radiating elements comprise conductive traces on the circuit board; and/or the antenna further comprises a coaxial cable having inner and outer conductors electrically coupled to the respective upper and lower portions of the antenna.

23. An omnidirectional multi-band antenna comprising:

an upper portion including one or more upper radiating elements and one or more slots, the one or more slots including a generally rectangular portion and two generally straight portions connected to and extending from the generally rectangular portion; the one or more upper radiating elements comprise high and low band radiating elements with one or more slots therebetween, the high band radiating element includes a generally rectangular shaped portion, the low band radiating element includes two generally straight portions extending alongside the generally rectangular portion of the high band radiating element and two end portions generally perpendicular to and extending inwardly from a corresponding one of the generally straight portions; and a lower portion including one or more lower radiating elements;

wherein at least one of the one or more upper radiating elements defining a generally V-shaped edge oriented so as to point generally toward the antenna's lower portion; and wherein:

the lower portion comprises two generally rectangular radiating elements and a generally rectangular ground element disposed between the two radiating elements, the two radiating elements spaced apart from the .ground element by the one or more slots of the lower portion of the antenna, the two radiating elements and ground element generally perpendicular to and connected to a generally rectangular connecting radiating element, and the lower portion is configured to be operable as a quarter wavelength (λ/4) choke at a first frequency range, such that at least a portion of the antenna current does not leak into an outer surface of a coaxial cable when the antenna is being fed by the coaxial cable; and/or the lower portion is operable as a sleeve choke at a first frequency range; and/or the lower portion is configured to be operable as ground.

24. The antenna of claim 23, wherein:

the antenna is operable within a first frequency range, with the upper and lower portions each having an electrical length of about λ/4; and the antenna is operable within a second frequency range, with the upper and lower portions each having an electrical length of about λ/2.

25. The antenna of claim 24, wherein:

the first frequency range is the 2.45 gigahertz band from about 2.4 gigahertz to about 2.5 gigahertz; and the second frequency range is the 5 gigahertz band from 4.9 gigahertz to 5.875 gigahertz.

26. The antenna of claim 24, wherein the antenna is configured such that:

at the first frequency range, the low band radiating element has an electrical length of about λ/4; and at the second frequency range, the high and low band radiating elements respectively have electrical lengths of about λ/4 and λ/2.

27. The antenna of claim 23, wherein:

the antenna further comprises a coaxial cable having inner and outer conductors electrically coupled to the respective upper and lower portions of the antenna; and/or the radiating elements, the one or more tapering features, and the one or more slots are on the same side of a printed circuit board; and/or the antenna further comprises a substrate supporting the upper and lower portions of the antenna on a same side of the substrate; and/or the antenna further comprises a circuit board supporting the upper and lower portions of the antenna on a same side of the circuit board, and wherein the radiating elements comprise conductive traces on the circuit board.

* * * * *